US006589700B2

(12) United States Patent
Tsutsumi et al.

(10) Patent No.: US 6,589,700 B2
(45) Date of Patent: Jul. 8, 2003

(54) IMAGE CARRIER AND APPARATUS AND METHOD FOR RECORDING IMAGE USING IMAGE CARRIER

(75) Inventors: Yasuyuki Tsutsumi, Saitama (JP); Shigeki Nishimura, Saitama (JP); Kazuya Yamanoi, Saitama (JP); Tadashi Kiyama, Saitama (JP); Kazuo Maruyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 22 days.

(21) Appl. No.: 09/951,487

(22) Filed: Sep. 14, 2001

(65) Prior Publication Data

US 2002/0064720 A1 May 30, 2002

(30) Foreign Application Priority Data

Nov. 24, 2000 (JP) ..... 2000-358286

(51) Int. Cl.[7] ..... G03G 5/147
(52) U.S. Cl. ..... 430/66; 399/159
(58) Field of Search ..... 430/66; 339/159

(56) References Cited

U.S. PATENT DOCUMENTS

| | | | | |
|---|---|---|---|---|
| 4,647,521 A | * | 3/1987 | Oguchi et al. | 430/58.05 |
| 5,666,193 A | | 9/1997 | Rimai et al. | |
| 6,368,764 B2 | * | 4/2002 | Tokutake et al. | 430/66 |

FOREIGN PATENT DOCUMENTS

| | | |
|---|---|---|
| JP | 52-126230 | 10/1977 |
| JP | 53-125027 | 11/1978 |
| JP | 54-109842 | 8/1979 |
| JP | 54-121133 | 9/1979 |
| JP | 56-126872 | 10/1981 |
| JP | 57-8569 | 1/1982 |
| JP | 57-23975 | 2/1982 |
| JP | 58-88770 | 5/1983 |
| JP | 58-140769 | 8/1983 |
| JP | 59-133573 | 7/1984 |
| JP | 59-157661 | 9/1984 |
| JP | 64-20587 | 1/1989 |
| JP | 1-134485 | 5/1989 |
| JP | 2-1870 | 1/1990 |
| JP | 2-81053 | 3/1990 |
| JP | 2-118671 | 5/1990 |
| JP | 2-118672 | 5/1990 |
| JP | 2-15776 | 6/1990 |
| JP | 3-114063 | 5/1991 |
| JP | 3-172880 | 7/1991 |
| JP | 7-234592 | 9/1995 |
| JP | 9-212010 | 8/1997 |
| JP | 9-230717 | 9/1997 |
| JP | 2000-206801 | 7/2000 |

* cited by examiner

*Primary Examiner*—Mark A. Chapman
(74) *Attorney, Agent, or Firm*—Morgan, Lewis & Bockius LLP

(57) ABSTRACT

In an image recording apparatus, the surface of an image carrier is formed of a material having a high affinity to particulates the particle size of which is smaller than toner and the surfaces of which have been treated to be hydrophobic, so that a layer of the particulates treated to be hydrophobic is retained on the surface of the image carrier.

20 Claims, 9 Drawing Sheets

IMAGE CARRIER AND APPARATUS AND METHOD FOR RECORDING IMAGE USING IMAGE CARRIER

BACKGROUND OF THE INVENTION

1. Field of the Invention

The present invention relates to an indirect transfer type image recording apparatus and an indirect transfer type image recording method in which a toner image formed on an image carrier is transferred to a recording medium or an intermediate transferor so as to record an image; and relates to an image carrier for use in such an image recording apparatus and such an image recording method. Particularly, the present invention relates to an image recording apparatus and an image recording method using electrophotographically recording technology, electrostatically recording technology, ionography, magnetography, etc., and an image carrier for use in such an image recording apparatus and such an image recording method.

2. Description of the Related Art

Conventionally, in such an indirect transfer type image recording technique, differently from an ink-jet printer or the like in which an image is recorded directly on a recording medium such as recording paper or the like, a toner image is first formed on an image carrier. The toner image formed on the image carrier is transferred to recording paper or the like. The transferred toner image is fixed to obtain a recorded image. Then, after the toner image is transferred to the recording medium such as recording paper or the like, residual toner on the image carrier is generally recovered and abolished by cleaning means. For example, in an electrophotographic image recording apparatus, an image is recorded by a charging step, an exposing step, a developing step, a transferring step, a fixing step, and a cleaning step. In the charging step, the surface of an image carrier having a photosensitive layer in the surface is charged uniformly. In the exposing step, the charged surface of the image carrier is irradiated with image light so that an electrostatic latent image is formed. In the developing step, toner is made to adhere to the electrostatic latent image so as to form a toner image. In the transferring step, the toner image is transferred to a recording medium. In the fixing step, the toner image on the recording medium is fixed. In the cleaning step, residual toner on the image carrier in the transferring step is removed. In the cleaning step of these steps, a rubber blade or a brush having flexibility is pressed against the surface of the image carrier so as to recover the residual toner on the surface of the image carrier, and the recovered toner is accumulated in a recovery vessel and abolished periodically.

In such an image recording apparatus, it is necessary to always detect or measure the quantity of recovered toner accumulated in the recovery vessel so as to abolish the toner or exchange the recovery vessel before the recovery vessel is full of the toner. In addition, if the image recording apparatus is miniaturized so that a large space for installing the recovery vessel cannot be ensured, the inside of a drum-like image carrier may be used as a space for recovering toner. In such a case, the time to exchange the image carrier has to be established in accordance with the quantity of recovered toner. Further, reuse of recovered toner has proceeded from the point of view of environmental protection. However, the reuse of recovered toner involves a lot of problems such as a problem of separation, a problem of energy for conveyance and reuse, a problem of a recovery method and a storage place, and so on.

As means to solve such problems, the following means have been considered. (1) First means is to improve the transfer efficiency with which a toner image is transferred to a recording medium. If the transfer efficiency to the recording medium is improved, residual toner on the image carrier is reduced correspondingly. Thus, the quantity of toner to be recovered and disposed of is also reduced. (2) Second means is to recover residual toner from the image carrier and return the residual toner to the developing means so as to reuse the toner for development. If all the recovered toner is reused, it is not necessary to abolish the toner. (3) Third means is to solve disadvantage caused by residual toner without cleaning the image carrier. Thus, it is not necessary to recover the residual toner by cleaning, and it is expected that waste toner is prevented from being produced.

As the first means (1) to improve the transfer efficiency, the following techniques have been proposed.

(a) In the technique disclosed in JP-A-56-126872, the area where an electric field is formed for transfer is increased to improve the transfer efficiency.

(b) In the technique disclosed in JP-A-58-88770 or JP-A-58-140769, an alternating electric field is formed in a transfer position. This alternating electric field applies force to toner on an image carrier so as to vibrate the toner. Thus, separation of the toner from the image carrier is accelerated.

(c) In the technique disclosed in JP-A-52-126230, ultrasonic waves are radiated to an image carrier in a transfer position so as to generate vibrations. Thus, the adhesive force of toner grains is reduced.

(d) In the technique disclosed in JP-A-2-1870, JP-A-2-81053, JP-A-2-118671, JP-A-2-118672, or JP-A-2-157766, strippable particulates of silica or the like are contained in a developer. The particulates are interposed between toner and a photosensitive body. Thus, the adhesive force between the toner and the photosensitive body is reduced so that the transfer efficiency of the toner is enhanced.

(e) In the technique disclosed in JP-A-1-134485, transparent and colorless toner is made to adhere to a latent image formed on an image carrier, and colored toner is further put thereon to adhere thereto. Then, development is carried out. In a toner image formed thus, approximately 100% of the colored toner is transferred.

Although each of the disclosed techniques (a), (b) and (c) shows the effect of improvement of the transfer efficiency, a certain degree of toner still stays behind in the image carrier after transfer. Therefore, those techniques are not satisfactory to reduce waste toner.

On the other hand, in the disclosed technique (d), it is necessary to add an adequate quantity of strippable particulates to the developer, and coat toner with the strippable particulates uniformly. Actually, however, it is difficult to coat all the toner with the strippable particulates uniformly. It is therefore impossible to eradicate the existence of toner coated insufficiently. In addition, even if all the toner is coated with the strippable particulates uniformly, the strippable particulates are free from the toner due to various stresses such as stirring, layer thickness regulation, and so on, given thereto in a developing machine. Therefore, to keep the toner coated with the strippable particulates uniformly, it is necessary to realize a developing machine which gives no stress to the toner. Further, since it is necessary to add a large quantity of strippable particulates, the strippable particulates may adhere to the toner surface or the carrier surface due to use for a long term so that the electification property of the developer may be degraded, or the free strippable particulates may be flocculated. Thus, the flowability of the developer may be lowered to cause uneven development. In addition, the toner to which a large quantity of strippable particulates have been added is rich in flowability so that a toner image is disarranged easily when the toner image abuts against a recording medium at the time of transfer. Thus, such a phenomenon that an image is disarranged due to transfer is also apt to be produced.

Further, in the disclosed technique (e), a large quantity of transparent and colorless toner stays behind after a toner image is transferred. Unless the transparent and colorless toner is cleaned and removed before a next image is formed, the surface of the image carrier cannot be made uniform. It is therefore necessary to recover and abolish the transparent and colorless toner by use of a cleaning unit. Thus, the problem to reduce waste toner cannot be solved.

As the technique (2) to reuse recovered toner, the following techniques have been proposed. In the technique disclosed in JP-A-54-121133, toner recovered by a cleaning unit is returned to a developing machine through a conveyance path so as to be reused. In the technique disclosed in JP-A-53-125027, a cleaning unit and a developing machine are integrated into a unit, and toner recovered by the cleaning unit is dropped or conveyed into a storage chamber where toner for use in development is accommodated. Further, a technique in which residual toner on an image carrier is recovered by a developing machine without providing a cleaning unit is disclosed, for example, in JP-A-54-109842, JP-A-59-133573, JP-A-59-157661, or the like. In such an apparatus, when an image is developed after a previous toner image has been transferred, toner staying behind in a background portion is transferred to a developing roll in an electric field in a development area so as to be recovered.

In the above-mentioned apparatus disclosed in JP-A-54-121133, JP-A-53-125027, JP-A-54-109842, JP-A-59-133573, and JP-A-59-157661, there is no case that recovered toner is accumulated, but paper dust or the like entrained at the time of transfer or the like is also recovered in the developing machine. Thus, the paper dust may cause an image defect. In addition, the electification property fluctuates due to repeated use of toner so that the stability of image density may be damaged. Thus, it may be necessary to exchange a developer accommodated in the developing machine for a new one, and abolish the old toner. Further, when a special device is used for conveying toner to the developing machine, the structure becomes complicated.

The above-mentioned technique (3) in which the cleaning step is not carried out is disclosed, for example, in JP-A-3-172880. Generally, unless an image carrier is cleaned after transfer, there arises a problem such as a positive ghost in which residual toner is printed out in the next image forming step, or a negative ghost caused by the light shielding effect of the residual toner. In the above-mentioned technique disclosed in JP-A-3-172880, the transfer efficiency of toner is increased to 80% or more so that such a ghost is prevented from being produced. On the other hand, JP-A-3-114063 discloses that the quantity of residual toner is made not larger than 0.35 mg/cm$^2$ so that the production of the ghost can be avoided. Further, another publication discloses a technique in which residual toner after transfer is disturbed with a brush or the like so as to prevent the residual toner from producing any ghost. However, to prevent the production of a ghost or the production of fog satisfactorily in such an apparatus, it is necessary to improve the transfer efficiency likewise.

Thus, as techniques which can solve the problems belonging to the techniques (1) to (3) all at once, there are proposed some methods for forming particulates or a high-releasable coating layer on the surface of an image carrier as follows.

JP-A-57-23975 discloses a technique for giving treatment to the surface of an image carrier so as to coat the image carrier with high-releasable silicon. In addition, JP-A-57-8569 discloses a technique for giving fluoropolymer treatment to the surface of an image carrier.

In addition, JP-A-7-234592 discloses a technique in which an elastic layer is provided on the surface of intermediate transfer means while microparticles the particle size of which is not larger than half of the grain size of toner is firmly fixed to the surface of the intermediate transfer means.

Further, U.S. Pat. No. 5,666,193 or JP-A-9-230717 discloses a technique in which particulates each having a volume-weighted diameter smaller than about 3 microns are partially planted in an elastic layer on the surface of an intermediate transfer member.

Furthermore, JP-A-9-212010 discloses a technique in which particulates each having a diameter smaller than that of toner are made to adhere substantially uniformly to the surface of an image carrier, and the toner is transferred onto the particulates.

Further, JP-A-2000-206801 discloses a technique in which an intermediate transferor has an inorganic coating layer.

However, the above-mentioned conventional techniques have problems as follows. That is, in the technique disclosed in JP-A-57-23975 or JP-A-57-8569, coating treatment with high-releasable silicon is given to the surface of the image carrier, or fluoropolymer treatment is given to the surface of the image carrier. In such a technique, the initial transfer rate cannot be improved beyond about 95%, and there is a limit in the improvement of the transfer rate. In addition, there is a problem that the surface subjected to silicon coating or fluoropolymer treatment is contaminated with the passage of time so that the transfer rate is degraded gradually.

On the other hand, in the technique disclosed in JP-A-7-234592, the initial transfer rate is sufficiently acceptable. However, there is a problem that the microparticles firmly fixed to the surface of the intermediate transfer means are detached with the passage of time so that the transfer rate cannot be kept for a long time.

Further, in the technique disclosed in U.S. Pat. No. 5,666,193 or JP-A-9-230717, it is necessary to plant particulates into the elastic layer on the surface of the intermediate transfer member surely. Actually, however, it is difficult to plant the particulates into the elastic layer on the surface of the intermediate transfer member surely. In addition, in the same manner as in the technique disclosed in JP-A-7-234592, the planted particulates are detached with the passage of time so that both the initial transfer rate and the tenability of the transfer rate are insufficient.

Further, in the technique disclosed in JP-A-9-212010, particulates each having a diameter smaller than that of toner are made to adhere substantially uniformly to the surface of the image carrier, and the toner is transferred onto the particulates. The initial transfer rate is sufficiently acceptable. However, there is a problem that the particulates adhering to the surface of the image carrier are detached due to mechanical stress or removed due to the adhesive force with the toner, so that the tenability of the transfer rate is insufficient.

Further, in the technique disclosed in JP-A-2000-206801, the intermediate transferor has an inorganic coating layer. In the same manner as in JP-A-57-23975 or JP-A-57-8569, the initial transfer rate cannot be improved beyond about 95%.

Thus, there is a problem that there is a limit in the improvement of the transfer rate.

As described above, to reduce toner to be recovered/abolished to the utmost, or to omit abolishment/disposal of toner, it is necessary to make the transfer efficiency and the tenability thereof better than those in the conventional techniques. In addition, to eradicate toner to be abolished, it is necessary to improve the transfer efficiency dramatically enough to prevent an image defect such as a ghost, fog, or the like, from being produced even if residual toner after transfer is not cleaned.

Thus, the present invention was developed to solve the foregoing problems belonging to the conventional techniques. It is an object of the present invention to provide an image carrier, and an image recording apparatus and an image recording method using the image carrier, in which the transfer efficiency can be improved on a large scale when a toner image is transferred to a recording sheet or an intermediate transferor so as to reduce toner to be recovered/abolished; or in addition, a cleaning unit can be dispensed with or simplified in accordance with necessity; production of waste toner can be prevented to the utmost; and high transfer efficiency is further kept stably for a long time.

To solve the foregoing problems, the image carrier, and the image apparatus and the image recording method using the image carrier according to the present invention has a feature that the surface of the image carrier for carrying a toner image is formed of a material having a high affinity to particulates the particle size of which is smaller than that of toner and the surfaces of which have been treated to be hydrophobic, and a layer of the particulates treated to be hydrophobic is provided on the surface of the image carrier.

Toner for visualizing a latent image is transferred onto the particulate layer. Thus, a toner image is formed in the state where the toner is laminated on the particulate layer. Generally, toner adheres to the image carrier by electrostatic force (occasionally sucked magnetically), but non-electrostatic adhesive force such as van der Waals force, or the like, also acts on the toner. However, if a toner image is formed on the particulate layer as described above, it is possible to form a gap between toner grains and the image carrier, or it is possible to reduce the contact area between the toner grains and the image carrier. Thus, non-electrostatic adhesive force such as van der Waals force, or the like, is reduced. Accordingly, if an electric field acts on the toner grains at the time of transfer, the toner grains are transferred easily by electrostatic force so that the transfer can be performed with high efficiency close to 100%.

To allow such a mechanism to last for a long time, it is presupposed that there is a particulate layer between the toner grains and the image carrier. It is therefore necessary to retain the particulate layer on the surface of the image carrier surely.

Therefore, according to the present invention, the surface of the image carrier is formed of a material having a high affinity to particulates the particle size of which is smaller than that of toner and the surfaces of which have been treated to be hydrophobic, and a layer of the particulates treated to be hydrophobic is retained on the surface of the image carrier.

As the material having a high affinity to the particulates treated to be hydrophobic, for example, there is a hydrophobic treatment agent. Active groups such as —C═O, —OH, —COOH, etc. on the surface of the image carrier, generally, react easily with the hydrophobic treatment agent having a coupling function with such active groups, so as to form hydrophobic groups on the surface of the image carrier. On the other hand, the surfaces of the particulates are also treated to be hydrophobic so that there are hydrophobic groups also on the surfaces of the particulates. As a result, the hydrophobic groups having a high affinity attract each other due to van der Waals force or the like. Thus, it is conceived that the particulates can be retained on the surface of the image carrier surely.

As another form showing such an affinity, there is an SP (Solubility Parameter) value. It has been proved that materials having SP values close to each other have a high affinity to each other. In addition, it has been proved that the hydrophobic agent of the particulates and the material provided on the image carrier come into tight contact with each other if the difference between the SP value of the hydrophobic agent of the particulates and the SP value of the material of the image carrier is not larger than 1.1 so that the transfer rate and the tenability thereof are superior.

As another form of such a material having a high affinity to the particulates, there is a material which is boiled at a temperature of 150° C. or lower, or which is hydrolyzed at a temperature of 150° C. or lower. By use of such a material, surface treatment can be given to the image carrier at a comparatively low temperature of 100° or lower, including a room temperature. Thus, it is possible to prevent thermal deformation of a rubber material, interface peeling of a member having a multi-layer structure, or the like, due to heating in the surface treatment step. Such interface peeling is caused by a difference in thermal expansion coefficient among constituent materials of the multi-layer member. As a result, it is possible to give treatment to any material constituting the image carrier or the intermediate transferor.

Examples of materials satisfying such properties may include hexamethyldisilazane (SP value 6.5, boiling point 126° C.), trimethylmethoxysilane (SP value 6.7, boiling point 57° C.), methyltrimethoxysilane (SP value 7.3, boiling point 102° C.), triethylchlorosilane (SP value 7.8, boiling point 145° C.), trimethylbromosilane (SP value 7.8, boiling point 80° C.), etc.

Next, description will be made about a surface treatment method with hexamethyldisilazane by way of example.

Spherical silica powder (particulates) is surface-treated with hexamethyldisilazane in advance, so as to have $(CH_3)_3Si$— groups on the surface and have an average particle size of 150 nm. One part by weight of the silica powder is mixed and stirred into 100 parts by weight of a hexamethyldisilazane solvent. The silica powder and the hexamethyldisilazane solvent have $(CH_3)_3Si$— groups in common. Therefore, the silica powder and the hexamethyldisilazane solvent have a high compatibility to each other so that they disperse easily. Thus, no precipitate is produced, and the work of solution preparation and application is easy.

This solution is applied onto an intermediate transfer drum as an intermediate transferor by use of a roll coater, air-dried at a temperature of 22° C. and a humidity of 55% for 5 hours, and further heat-treated in a drying furnace at 100° C. for 1 hour. During such air-drying and heat-treating, hexamethyldisilazane as a solvent reacts with moisture in the air so as to be hydrolyzed, and reacts with active groups contained in the surface layer material on the intermediate transfer drum so as to form $(CH_3)_3Si$— groups on the surface layer. Thus, the silicon powder and the intermediate transferor surface have common chemical species even in the solid-layer state as well as in the solution state. It is therefore possible to form a thin layer with high adhesion property.

Although the above description was made in the case where hexamethyldisilazane was used as a solvent for silicon powder, the treatment agent for the silicon powder and the solvent therefor do not have to be the same species. For example, even if a solution in which the above-mentioned silicon powder is dispersed into a solvent of triethylchlorosilane is used as coating, similar effects can be obtained. Various combinations can be made.

Further, as another form, the above-mentioned high-affinity material does not have to be formed later on the image carrier surface. That is, arrangement may be made so that the material forming the surface of the image carrier have a low affinity to the high-affinity material and the high-affinity material is dispersed into the surface material of the image carrier. With such an arrangement, a so-call bleed phenomenon occurs so that the high-affinity material runs out on the surface of the image carrier gradually. Thus, it is possible to obtain a similar effect to that in the case where the high-affinity material is applied to the surface of the image carrier.

Description will be further made about this example. For example, in an intermediate transfer drum using a mixture of acrylic resin and silicon resin as a surface layer material, KPN3504 or KBM3103 and further KBM7103 made by Shin-Etsu Chemical Co., Ltd. are added into the surface layer material in advance. Such a solution is applied by a roll coating method or the like so as to form a surface layer. The above-mentioned additives shift to the surface of the surface layer in a coating film forming step (heat treatment step) because the additives are low molecular weight components. When the above-mentioned solution in which silicon powder surface-treated with hexamethyldisilazane is dispersed into hexamethyldisilazane is applied to the intermediate transfer drum in which the additives have shifted to the surface, the additives added in advance react with hexamethyldisilazane so as to forma firmer surface-treated layer. Incidentally, KPN3504 made by Shin-Etsu Chemical Co., Ltd. is an aminosilane mixture, KBM3103 likewise is decyltrimethoxysilane, and KNM7103 likewise is γ-mercaptopropyltrimethoxysilane.

Incidentally, all the toner grains to be transferred onto the image carrier to which the particulates adhere substantially uniformly do not have to be always transferred onto the particulates adhering to the image carrier. If most of the toner grains are transferred onto the particulates, it is still possible to obtain a transfer effect substantially as high as that in the case where all the toner grains are transferred onto the particulates, even though a part of the toner grains are transferred directly onto the image carrier.

In addition, when the image recording apparatus is an apparatus in which an image carrier having a photosensitive layer is irradiated with image light so as to form a latent image, or when the image recording method is to irradiate an image carrier having a photosensitive layer with image light so as to form a latent image, the particulates may be composed of a light transmissive material. In this case, after a uniform particulate layer is formed on the surface of the image carrier, if the surface of the image carrier is charged uniformly and irradiated with image light from above the particulate layer, an accurate latent image can be formed. Thus, the image visualized by the adhesion of the toner becomes clear. In this case, the light transmission property is involved in effective transmission property with respect to light of wavelength in service for image exposure. That is, if the particle size of the particulates is not larger than ½ of the wavelength of light for image exposure, the particulates do not cause an obstacle to exposure even if the particulates are opaque in view of its material structure. Such particulates are included in the light transmissive particulates referred to in the present invention.

The particulates on the image carrier may be transferred uniformly in advance before the image recording apparatus is put into service, or the particulates may be supplied onto the image carrier by particulate supply means in an early stage when the image recording apparatus is put into service. In either case, at least the surface of the image carrier has to be beforehand coated with a material having a high affinity to the particulates treated to be hydrophobic.

In addition, it is preferable that the particulate supply means can supplement particulates transferred from the image carrier to a recording medium or the like together with the toner, appropriately, so that the particulates adhere onto the image carrier substantially uniformly whenever an image is formed. As the means for transferring the particulates to the image carrier, various forms can be adopted. For example, there may be adopted means which has the same configuration as the developing machine and which accommodates powder particulates in place of colored toner, or means which accommodates a developer including both toner and powder and which also functions as both the particulate supply means and the developing machine. This means which functions as both the particulate supply means and the developing machine may transfer the powder uniformly in the state where no latent image is formed, before forming a latent image and transferring the toner. Alternatively, the means may transfer the particulates included in the developer onto the latent image carrier together with the toner simultaneously so as to form or keep a uniform layer of the particulates. On the other hand, as a method for making the particulates adhere to the surface of the image carrier electrically, other than the above-mentioned means having the same configuration as the developing machine, there is a method in which particulates are dispersed like cloud and made to adhere to the surface of the image carrier by the force of an electric field. As means for dispersing the particulates like cloud and making the particulates adhere to the surface of the image carrier, for example, there is a method using mechanical vibration, the air, an ultrasonic wave, or an alternating electric field, or a method in which particulates are made to adhere to a body like a roll, a brush, a web, or a paintbrush, and the body with the particulates is rotated, vibrated or moved. Alternatively, the powder may be rubbed mechanically by a rotary brush, a magnetic brush in which granulates are connected to be spicate by magnetism, a roll formed of a flexible elastic body, felt, a paintbrush, or the like. Such a mechanical method may be used together with the above-mentioned electric method.

Particulate smoothing means is prepared separately from the particulate supply means. The particulates supplied from the particulate supply means onto the image carrier are not always uniform. In addition, the particulates have a tendency to accumulate with the passage of time. In such a case, the particulate smoothing means is effective. As the particulate smoothing means, various forms may be adopted. A rotatable brush, a rotatable roll, an endless belt, or the like, is preferable. Particularly, it is preferable that the rotatable brush, the rotatable roll or the endless belt is conductive with a volume resistivity in a range of from $10^6$ Ωcm to $10^{13}$ Ωcm, and a bias voltage in a range of from −1,000 V to +1,000 V is applied to the rotatable brush, the rotatable roll or the endless belt, while the rotatable brush, the rotatable roll or the endless belt has a difference in velocity from the image carrier. With such a configuration, there is an effect that flocculates of particulates supplied onto the image carrier later are disentangled to be smoothed. Although the mechanism is not quite understood, even if there is a portion where the particulates on the image carrier are detached, particulates are supplied to that portion, and the material having a high affinity to the particulates on the image carrier attracts the particulates by priority. Thus, there is an effect that the particulate layer is repaired easily.

Alternatively, another means is used also as the particulate smoothing means without providing any special particulate smoothing means. As apparatus or steps which can be used also as the particulate smoothing means, there are apparatus for cleaning, temporarily cleaning, contact-charging, contact-transferring, and so on. In each case, the apparatus can be used as a particulate smoother at the same time as or at a timing different from its original step. On these occasions, it is obvious from the above description that a velocity difference from the image carrier is effective in each case. Further, if there is provided a velocity difference between image carriers, for example, between a photosensitive body and an intermediate transferor or the like, the image carriers function as particulate smoothers in the same manner. Using another member also as the particulate smoothing means has an immeasurable merit on the simplification of the apparatus configuration.

As another form of the particulate smoothing means, there is a method in which abrasive particulates are supplied separately from the above-mentioned particulates. As the abrasive particulates, ones smaller in size than the toner can be used in the same manner as the above-mentioned particulates. However, it is preferable that the shapes of the abrasive particulates are undefined or the surfaces thereof are not smooth. The above-mentioned particulate smoothing means can be used also as means for supplying the abrasive particulates. However, the abrasive particulates have smoothing ability so high that the surface of the image forming means is damaged in excess supply of the abrasive particulates. It is therefore preferable that the abrasive particulates are usually supplied at a weight ratio in a range of from 0.01% to 1.0% with respect to the toner. As the method for supplying the abrasive particulates, independent supply means may be provided, or the abrasive particulates may be contained in the developer, in the same manner as the above-mentioned particulates.

As for the properties of the above-mentioned particulates, it is preferable that the volume resistivity is set to be in a range of from $1\times10^{8}$ Ωcm to $1\times10^{14}$ Ωcm. By use of the particulates satisfying this condition, even if the adhesive force between the image carrier and the particulates is lowered, it is possible to reduce the quantity of the particulates electrostatically transferred from the image carrier to a recording medium or the like. Thus, the tenability of the particulate layer is improved so that excellent transfer properties can be obtained stably. The reason whey such an excellent result can be obtained will be described as follows. The above-mentioned particulates are interposed between the toner and the image carrier so as to reduce the adhesive force therebetween. Thus, the particulates have an effect to improve the transfer efficiency. After a toner image is transferred, most of the particulates themselves remain on the image carrier. However, a part of the particulates are transferred together with the toner when the toner image is transferred. There is a correlation between such a tendency and the volume resistivity of the particulates made to adhere to the image carrier. That is, particulates high in volume resistivity are apt to be transferred together with the toner when the toner image is transferred. On the contrary, particulates low in volume resistivity are apt to remain on the image carrier. This is due to the electrification properties of the particulates. If the volume resistivity of the particulates adhering to the surface of the image carrier is high, the particulates are charged easily in the step where the image carrier is charged. For example, in the case where the electrification polarity of the image carrier is minus, the particulates are charged to be minus. At this time, the potential caused by the charges of the particulates is lower than the potential of the image carrier. However, it reaches several percentages to several tens of percentages of the potential of the image carrier because of some volume resistivity. When the particulates charged to the same polarity as the electrification polarity of the image carrier in such a manner suffer a transfer electric field of the reverse polarity in the transfer step, a part of the particulates are transferred together with the toner by electrostatic force (Coulomb force). Therefore, if the volume resistivity of the particulates is low, that is, if the volume resistivity is lower than about $1\times10^{14}$ Ω·cm, unnecessary charging is prevented so that the particulates are prevented from being transferred from the surface of the image carrier by Coulomb force at the time of transfer. Thus, the particulate layer on the image carrier can be retained. On the contrary, if the volume resistivity of the particulates is lower than about $1\times10^{8}$ Ω·cm, charge transfer occurs through the particulates on the image carrier. Thus, if the image carrier is a photosensitive body, there arises a defect that an electrostatic latent image becomes unclear (an image is blurred).

It is preferable that the thickness of the particulates on the image carrier is not larger than 3 μm, and the particulate layer is formed from about 1 to 5 layers. If the thickness increases, the particulate layer is apt to be uneven to cause transfer density unevenness. Even if an even layer can be formed, a transfer electric field is weakened by the particulate layer so as to cause the lowering of the transfer rate.

On the contrary to those of the abrasive particulates, spherical or smooth-surface convex shapes can be adopted as the shapes of the particulates. This is because such shapes can make a uniform particulate layer easily, that is, the contact between the image carrier and the particulates becomes uniform easily, and the contact between the formed particulate layer and the toner also becomes uniform easily so that the transfer rate becomes uniform.

For the particulate layer to improve the transfer rate, any toner shape and any toner grain size may be used. However, spherical toner is more preferable. The spherical toner is so low in toner adhesive force and so uniform that the transfer rate is very high. Thus, a cleaner can be omitted.

As another form for making the present invention more effective in service, the surface of the image carrier is formed of a material having a high affinity to particulates treated to be hydrophobic, and the contact angle of the surface of the image carrier having the particulates treated to be hydrophobic is set to be not larger than 100°, preferably not larger than 90°, with respect to pure water. In a conventional system, for example, in JP-A-8-152786, to make it possible to omit a cleaning unit, it is necessary to make the contact angle of the surface of a photosensitive body not smaller than 90°. The large contact angle results in the reduction of surface energy. Thus, it becomes difficult for toner to adhere. As a result, the transfer rate is improved. This sounds logical. On the other hand, according to the acute investigation of the present inventor, it was proved that if the contact angle was not smaller than 100°, the initial transfer rate was indeed excellent, but the tenability thereof was not excellent, though the reason was not known well. On the contrary, it was proved that if the contact angle was not larger than 100°, both the initial transfer rate and the tenability thereof were very excellent, and particularly if the contact angle was not larger than 90°, they became especially excellent. It is estimated that when the image carrier has a contact angle not smaller than 100°, the adhesive force of the particulates to the image carrier is weak to be easily detached. As the image carrier according to the present invention, there can be used one in which particulates treated to be hydrophobic are provided on the surface of the image carrier, and the contact angle of the image carrier having the particulates on the surface is not larger than 100°, preferably not larger than 90°.

As another form for making the present invention more effective in service, the surface of the image carrier which has not yet been coated with the material having an affinity to the particulates has a resin layer, and the substrate of the image carrier has elasticity. The material having an affinity to the particulates are fixed more firmly and more stably so that the tenability of the transfer rate becomes more excellent. In this case, the substrate of the image carrier may be set to be not larger than 30° in JISA hardness. The adhesion between the toner and the image carrier is improved. Thus, the transfer efficiency is improved not only when the toner is transferred to the image carrier, but also when the toner is transferred from the image carrier (for example, when the toner is transferred from a photosensitive body as an intermediate transferor). In addition, a similar effect can be obtained when the microhardness of the substrate of the image carrier is in a range of from 20° to 60°.

Here, a microhardness meter for measuring the microhardness is made up for measuring hardness of small, thin and soft rubber parts which could not be measured by a conventional ASKER-C rubber hardness meter or the like. A measured value of the microhardness meter has hardness information in the vicinity of the surface of a microscopic measuring portion in comparison with a conventional hardness measured value. As such a microhardness meter of this type, there is a "Micro durometer (type MD-1)" made by KOBUNSHI KEIKI CO., LTD. The MD-1 durometer is used as the microhardness meter in the present invention.

DETAILED DESCRIPTION OF THE PREFERRED EMBODIMENTS

A description will be made below about embodiments of the present invention with reference to the drawings.

Embodiment 1

Figure 2:
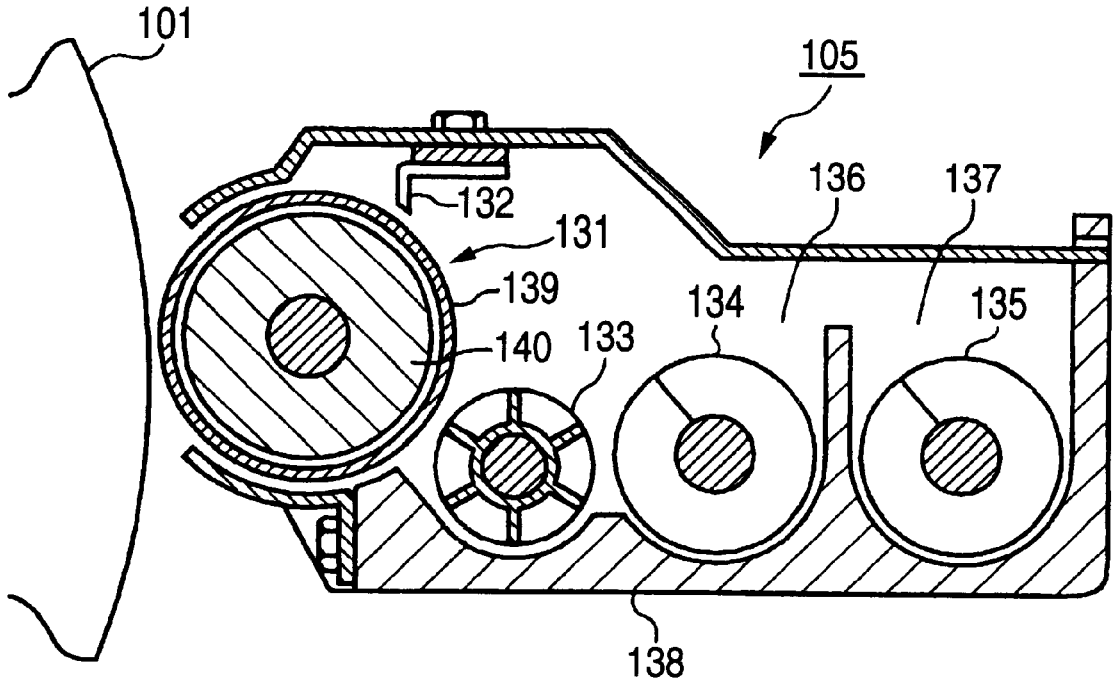
FIG. 2 is a schematic diagram showing a developing unit of the image recording apparatus according to Embodiment 1 of the present invention.

FIG. 2 shows an image recording apparatus according to Embodiment 1 of the present invention.

This image recording apparatus has a photosensitive drum 101, a charger 102, a particulate supply unit 103, an image writing unit 104, a developing unit 105, a transfer charger 106, a separating charger 107, a conveying belt 110, and a destaticizing exposure unit 108. The photosensitive drum 101 is an image carrier which is irradiated with image light after being charged uniformly so that an electrostatic latent image is formed on the surface. The charger 102 is disposed in the outer circumference of the photosensitive drum 101. The charger 102 is a charging means for charging the surface of the photosensitive drum 101 to a predetermined potential. The particulate supply unit 103 supplies light-transmissive particulates to the surface of the photosensitive drum 101 uniformly. The image writing unit 104 irradiates the surface of the photosensitive drum 101 with image light on the basis of image data so as to form an electrostatic latent image. The developing unit 105 transfers toner to the electrostatic latent image selectively so as to visualize the electrostatic latent image. The transfer charger 106 transfers a toner image on the surface of the photosensitive drum 101 to paper as a recording medium supplied from a paper guide 109. The separating charger 107 separates, from the surface of the photosensitive drum 101, the paper to which the toner image has been transferred. The conveying belt 110 conveys the separated paper to a not-shown fixing unit. The destaticizing exposure unit 108 destaticizes the surface of the photosensitive drum 101 from which the paper has been separated.

The photosensitive drum 101 is disposed to be driven to rotate at a predetermined velocity in the arrow direction by not-shown driving means. Drums having various photosensitive layers may be used as the photosensitive drum 110. For example, a drum having a photosensitive layer formed of an organic photo-conductor (OPC) is used.

The surface of the photosensitive drum 101 is formed of a material having a high affinity to particulates the particle size of which is smaller than toner and the surfaces of which have been treated to be hydrophobic. Thus, as shown in FIGS. 3A to 3D, a layer of the particulates treated to be hydrophobic is formed uniformly on the surface of the photosensitive drum 101.

As the material having a high affinity to the particulates treated to be hydrophobic, for example, a hydrophobic treatment agent is used. As the hydrophobic treatment agent, there is desired a material which is boiled at a temperature of 150° C. or lower, or which is hydrolyzed at a temperature of 150° C. or lower. By use of such a material, treatment can be given to the surface of the image carrier at a comparatively low temperature not higher than 100° C. including a room temperature. Thus, it is possible to prevent thermal deformation of a rubber material, interface peeling, or the like, due to heating in the surface treatment step. Such interface peeling is caused by a difference in thermal expansion coefficient among layers constituting a multi-layer photosensitive layer. As a result, it is possible to give treatment to any material constituting the image carrier or the intermediate transferor.

Examples of materials satisfying such properties may include hexamethyldisilazane (SP value 6.5, boiling point 126° C.), trimethylmethoxysilane (SP value 6.7, boiling point 57° C.), methyltrimethoxysilane (SP value 7.3, boiling point 102° C.), triethylchlorosilane (SP value 7.8, boiling point 145° C.), trimethylbromosilane (SP value 7.8, boiling point 80° C.), etc.

For example, a solution of a hydrophobic treatment agent is applied to the surface of the photosensitive drum 101. Thus, the surface of the photosensitive drum 101 is formed of a material having a high affinity to the particulates treated to be hydrophobic. Generally, active groups such as —C═O, —OH, —COOH, etc. are present on the surface of the photosensitive drum 101. The active groups react easily with the hydrophobic treatment agent having a coupling function with such active groups, so as to form hydrophobic groups on the surface of the photosensitive drum 101.

On the other hand, examples of the particulates treated to be hydrophobic may include $SiO_2$, $TiO_2$, etc. Examples of hydrophobic silica particulates may include high-hydrophobic silica particulates produced in such a manner that fumed silica obtained by combustion hydrolysis in vapor phase by use of a volatile silicon compound such as silicon tetrachloride or the like as a raw material is treated with organochlorosilane such as methyldichlorosilane or the like, or organosiloxane such as polydimethylsiloxane or the like, so that silanol groups on the surface are sealed off; arc silica particulates obtained by burning silicon monoxide evaporating from an arc furnace; hydrophobic silica particulates produced in such a manner that silanol groups on the surface are sealed off by treatment with hexamethyldisilazane; and so on.

The kind of the treatment agent for making the surfaces of titanium oxide particulates hydrophobic, such as various coupling agents of silane, titanate, aluminum, zirconium aluminate, etc.; silicon oil; or the like; may be changed, or the loading of the treatment agent may be adjusted suitably.

In addition, as the particulates treated to be hydrophobic, alumina, calcium carbonate, magnesium carbonate, calcium phosphate, cerium oxide, and soon, subjected to similar surface treatment may be used other than the above-mentioned particulates.

Whether the material forming the surface of the photosensitive drum 101 has a high affinity to the particulates treated to be hydrophobic or not is, for example, judged by SP values. It has been proved that material shaving SP values close to each other have a high affinity to each other. When the difference in SP value between the hydrophobic treatment agent for the particulates and the material provided on the surface of the photosensitive drum 101 is not larger than 1.1, the particulates and the surface of the photosensitive drum 101 come into tight contact with each other excellently. Thus, the transfer rate and the tenability thereof become excellent as will be described later.

A layer of the particulates treated to be hydrophobic is formed uniformly on the surface of the photosensitive drum 101, for example, when the photosensitive drum 101 is manufactured. However, without any limitation to the above description, a layer of the particulates treated to be hydrophobic may be formed uniformly on the surface of the photosensitive drum 101 before the image forming step.

Next, description will be made about the case where a layer of the particulates treated to be hydrophobic is formed uniformly by use of hexamethyldisilazane as the hydrophobic treatment agent when the photosensitive drum 101 is manufactured, by way of example.

One part by weight of spherical silica powder (particulates) which is surface-treated with hexamethyldisilazane in advance so as to have $(CH_3)_3Si$— groups on the surface and which has an average particle size of 150 nm is mixed and stirred into 100 parts by weight of a hexamethyldisilazane solvent. The silica powder and the hexamethyldisilazane solvent have $(CH_3)_3Si$— groups in common. Therefore, the silica powder and the hexamethyldisilazane solvent have high compatibility so that they disperse easily. Thus, no precipitate is produced, and the work of solution preparation and application is easy.

This solution is applied onto the photosensitive drum 101 by a roll coater, air-dried at a temperature of 22° C. and a humidity of 55% for 5 hours, and further heat-treated in a drying furnace at 100° C. for 1 hour. During the air-drying and the heat treatment, hexamethyldisilazane as a solvent reacts with moisture in the air so as to be hydrolyzed, and reacts with the active groups contained in the material of the surface layer on the photosensitive drum 101 so as to form $(CH_3)_3Si$— groups in this surface layer. Thus, the silicon powder and the surface of the photosensitive drum 101 have common chemical species in the solid layer state as well as in the solution state. As a result, a high-adhesive thin layer can be formed.

The charger 102 for uniformly charging the surface of the photosensitive drum 101 arranged thus applies a high voltage to an electrode wire so as to generate corona discharge between the electrode wire and the photosensitive drum 101. Thus, the surface of the photosensitive drum 101 is charged uniformly. Incidentally, a contact type charger such as a charging roll, a charging blade, a charging film, or the like, may be used as the charger 102.

The image writing unit 104 has a large number of light-emitting devices (LEDs) arrayed in the width direction of an image to be formed. These light-emitting devices turn on and off on the basis of image signals so as to perform image exposure onto the photosensitive drum 101 which is driven to rotate. As the image writing unit 104, not to say, a laser beam may be turned on and off on the basis of image signals while scanning the photosensitive drum 101, so as to perform image exposure thereon.

As shown in FIG. 2, the developing unit 105 has a cylindrical developing roll 131 and a developer regulating member 132 in a developing unit housing 138. The developing roll 131 is disposed to be close to and opposite to the photosensitive drum 101. The developer regulating member 132 regulates the developer quantity on the developing roll 131. The developing roll 131 is constituted by a magnet roll 140 and a non-magnetic hollow cylindrical developing sleeve 139. The magnet roll 140 has a plurality of magnetic poles in the circumferential direction. The developing sleeve 139 is supported around the magnet roll 140 rotatably. A developer composed of carriers and toner can be magnetically sucked and conveyed on the outer circumference of the developing sleeve 139.

In addition, a paddle 133 for supplying the developer to the developing roll 131 is provided behind the developing roll 131, and a first stirring chamber 136 and a second stirring chamber 137 are formed further behind the paddle 133. The first and second stirring chambers 136 and 137 are provided with a first auger 134 and a second auger 135 for conveying the developer in the axial direction of the developing roll 131 while stirring the developer, respectively. As the developer used in this developing unit 105, a mixture of magnetic carriers and toner is used. In addition, external additives may be added to the toner. Incidentally, it is desired that substantially spherical toner is used as the toner.

The particulate supply unit 103 has the same configuration as the developing unit. However, a particulate feed agent which is a mixture of magnetic carriers and light transmissive particulates is accommodated, in place of the developer, in the inside of the particulate supply unit 103. When a layer of particulates has not been formed on the surface of the photosensitive drum 101 initially, the particulate supply unit 103 is used to supply particulates uniformly to the surface of the photosensitive drum 101 in an early stage of the image forming operation so as to form a layer of the particulates. On the contrary, when a layer of particulates has been formed on the surface of the photosensitive drum 101 initially, the particulate supply unit 103 is used to supplement particulates detached from the surface of the photosensitive drum 101 in the image forming step.

As the particulates supplied by the particulate supply unit 103, particulates similar to those when a layer of particulates is formed on the surface of the photosensitive drum 101 initially are used as described above. That is, as the particulates, for example, spherical silica powder which is surface-treated with hexamethyldisilazane in advance so as to have $(CH_3)_3Si$— groups on the surface and which has an average particle size of 150 nm is used.

When the photosensitive drum 101 is used as an image carrier, the above-mentioned particulates are formed into a layer uniformly on the surface of the photosensitive drum 101. It is therefore necessary for the particulates to have light transmission property good enough to form an electrostatic latent image by image exposure. When the particulates are formed of a light transmissive material, an accurate latent image can be formed even in the following manner. That is, after a uniform layer of the particulates is formed on the surface of the photosensitive drum 101, the surface of the photosensitive drum 101 is charged uniformly, and irradiated with image light from above the layer of the particulates. Thus, an image visualized by the adhesion of the toner becomes clear. In this case, the light transmission property is involved in effective transmission property with respect to light of wavelength in service for image exposure. That is, if the particle size of particulates is not larger than ½ of the wavelength of light for image exposure, the particulates do not cause an obstacle to exposure even if the particulates are opaque in view of its material structure. Such particulates are included in the light transmissive particulates referred to in the present invention.

In the configuration described above, in the image recording apparatus according to this embodiment, in the following manner, it is possible to improve the transfer efficiency on a large scale when a toner image is transferred to a recording sheet or an intermediate transferor so as to reduce toner to be recovered/abolished; or in addition, it is possible to enable a cleaning unit to be dispensed with or simplified; it is possible to prevent production of waste toner to the utmost; and it is further possible to keep high transfer efficiency stably for a long time.

Figure 1:
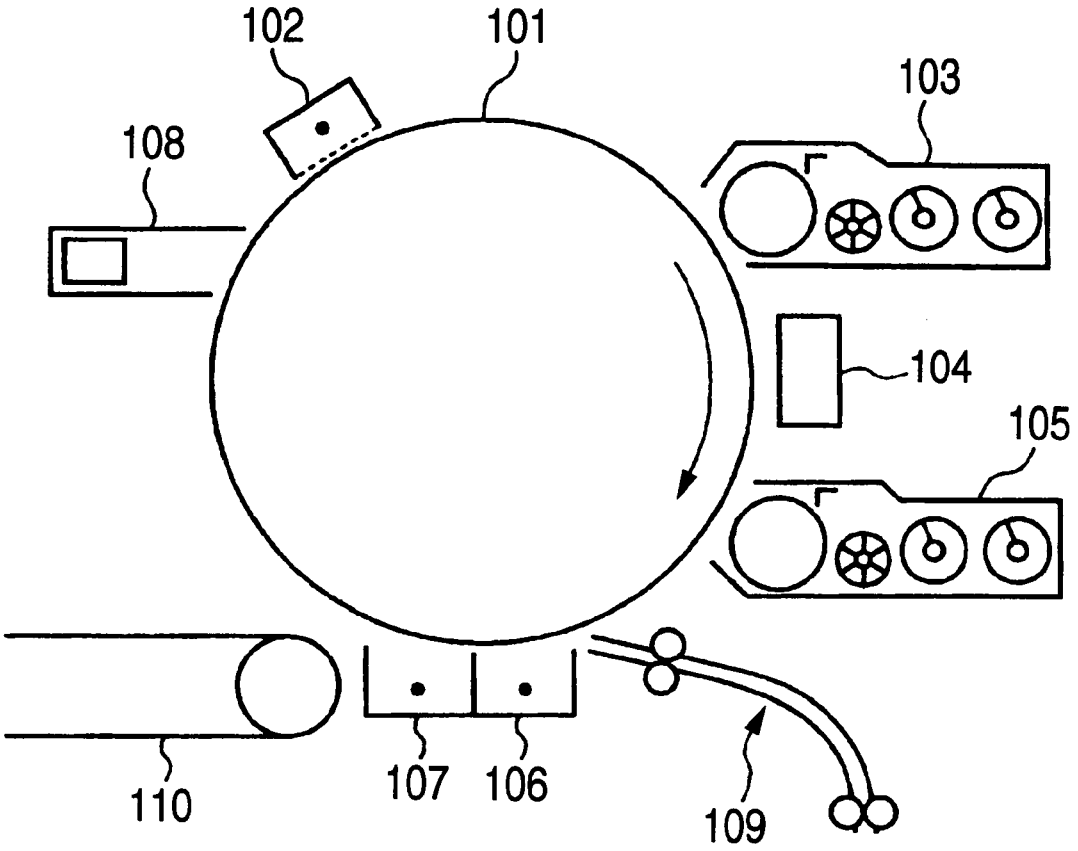
FIG. 1 is a schematic diagram showing an image recording apparatus according to Embodiment 1 of the present invention.
Figure 3A:
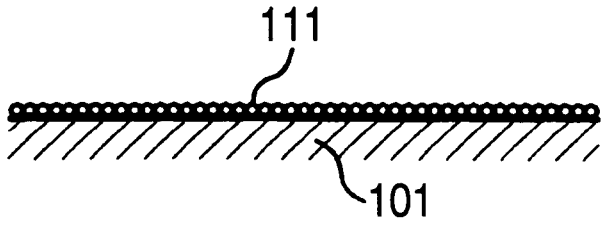
FIGS. 3A to 3D are explanatory diagrams showing image recording processes of an image recording apparatus according to Embodiment 2 of the present invention.

That is, in the image recording apparatus according to this embodiment, as shown in FIG. 1, the photosensitive drum 101 is driven to rotate at a predetermined velocity (for example, peripheral velocity of 160 mm/s) in the arrow direction. The surface of the photosensitive drum 101 is charged uniformly to have predetermined polarity and predetermined potential (for example, −550 V) by the charger 102. After or before the charging, the particulates are supplied uniformly to the surface of the photosensitive drum 101 by the particulate supply unit 103. On the surface of a particulate feed agent retention roll belonging to the particulate supply unit 103, a magnetic brush of carriers is formed by the magnetic force of the magnet roll. Particulates formed of spherical silica powder or the like adhere to the carriers. Then, the magnetic brush abuts against the surface of the photosensitive drum 101 so as to rub the particulates against the surface. Thus, as shown in FIG. 3A, a substantially uniform particulate layer is formed on the surface of the photosensitive drum 101. At this time, the particle size of the particulates is so small that the quantity of charges with which the particulates are charged is also small. Thus, electrostatic force does not act dominantly.

However, the surface of the photosensitive drum 101 is formed of a material having a high affinity to the particulates surface-treated to be hydrophobic, while the particulates are surface-treated to be hydrophobic so that hydrophobic groups are present also on the surfaces of the particulates. Thus, such hydrophobic groups having a high affinity to each other attract each other due to van der Waals force or the like. Consequently, the particulates are retained on the surface of the photosensitive drum 101 surely.

Figure 3B:
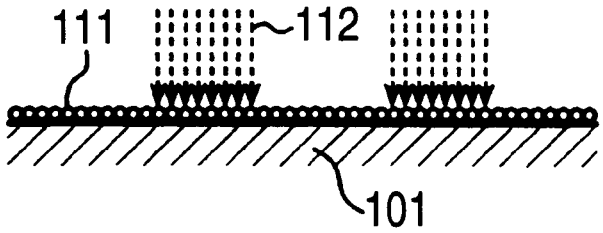
Figure 3C:
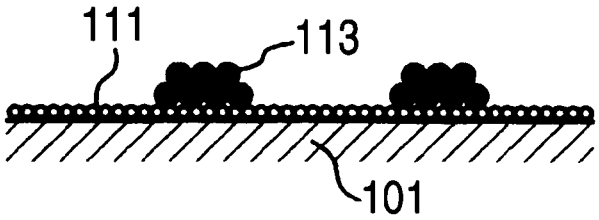
Figure 3D:
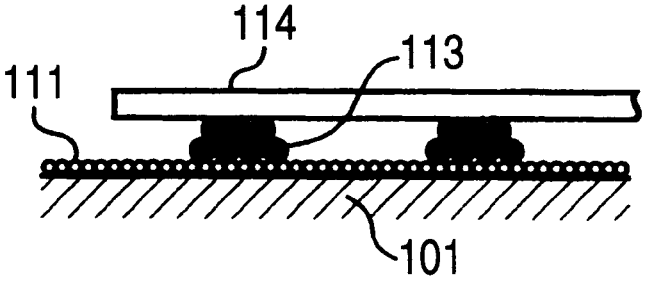

Next, the position opposite to the image writing unit 104 is irradiated with image light from above the particulate layer as shown in FIG. 3B. The particulates used transmit light so that the charges of the photosensitive layer of the photosensitive drum 101 are reduced by exposure. Thus, a latent image is formed in accordance with a difference in electrostatic potential. This latent image is moved to the position opposite to the developing unit 105. Toner 113 transferred from the developing roll 131 is put on the particulate layer so as to adhere thereto as shown in FIG. 3C. Thus, the latent image is visualized. The toner image formed thus is transferred to recording paper 114 by the transfer unit 106 as shown in FIG. 3D. Since the toner 113 adheres onto the photosensitive drum 101 through the particulate layer 111, non-electrostatic adhesive force such as van der Waals force or the like is weakened between the toner and the photosensitive drum 101. Thus, the toner 113 is separated easily by an electric field generated by the transfer unit 106, so as to be transferred to the recording paper 114.

After the toner image has been transferred to the recording paper in such a manner, the particulate layer 111 remains on the photosensitive drum 101. In this image recording apparatus, a cleaning unit is not provided. The next image forming step starts as the particulate layer 111 is kept on the photosensitive drum 101. Then, particulates is transferred from the particulate supply unit 103 so as to supplement particulates transferred to the recording paper when the toner image was transferred. On the other hand, no residual toner is produced if the toner transfer rate is 100%. Actually, however, a small amount of the toner remains on the photosensitive drum 101. In the next image forming step, some of such residual toner is recovered by the particulate supply unit 103, and some is recovered by the developing unit 105. Further, some of the residual toner reaches the transfer position while being kept on the photosensitive drum 101, and transferred to the recording paper together with the next image.

Incidentally, a temporarily cleaning unit or a cleaning unit may be provided on the downstream side of the transfer charger 106 in such an apparatus. In this case, however, there is produced a large quantity of recovered particulates if all the particulates on the photosensitive drum 101 are recovered. Thus, it is necessary to supplement fresh particulates. Therefore, as the cleaning unit, it is necessary to adopt a unit by which only toner can be recovered as the particulate layer is kept, for example, a unit for recovering only toner by electric force, a unit for recovering only toner by weak force with a brush or the like.

As the temporarily cleaning unit or the cleaning unit, for example, a rotatable roll or an endless belt is used. The rotatable roll or the endless belt is conductive with a volume resistivity in a range of from $10^6$ Ωcm to $10^{13}$ Ωcm. A bias voltage in a range of from −1,000 V to +1,000 V is applied to the rotatable brush or the endless belt. The rotatable brush or the endless belt is designed to have a difference in velocity from the photosensitive drum 101.

EXAMPLE 1

Next, the present inventors manufactured an image recording apparatus as shown in FIG. 1, by way of trial. Then, experiments were carried out to investigate initial transfer residual density as an initial toner image transfer rate, and transfer residual density after transferring 10 thousand times. There was used an image carrier in which a hexamethyldisilazane solution in which 0.15 μm silica particulates were dispersed was applied onto an OPC photosensitive body. The thickness of a particulate layer was 0.5 μm, and spherical particulates were used. Similar experiments were carried out using silica particulates having undefined shapes.

As a result, it was proved that when the spherical particulates were used, the initial transfer residual density showing the initial toner image transfer rate and the transfer residual density after transferring 10 thousand times were very low and satisfactory to be 0.01 and 0.04 respectively. On the other hand, when the undefined particulates were used, the initial transfer residual density showing the initial toner image transfer rate and the transfer residual density after transferring 10 thousand times were satisfactory to be 0.03 and 0.05 respectively. However, it was proved that the spherical particulates were more preferable particularly in initial performance.

Embodiment 2

Figure 4:
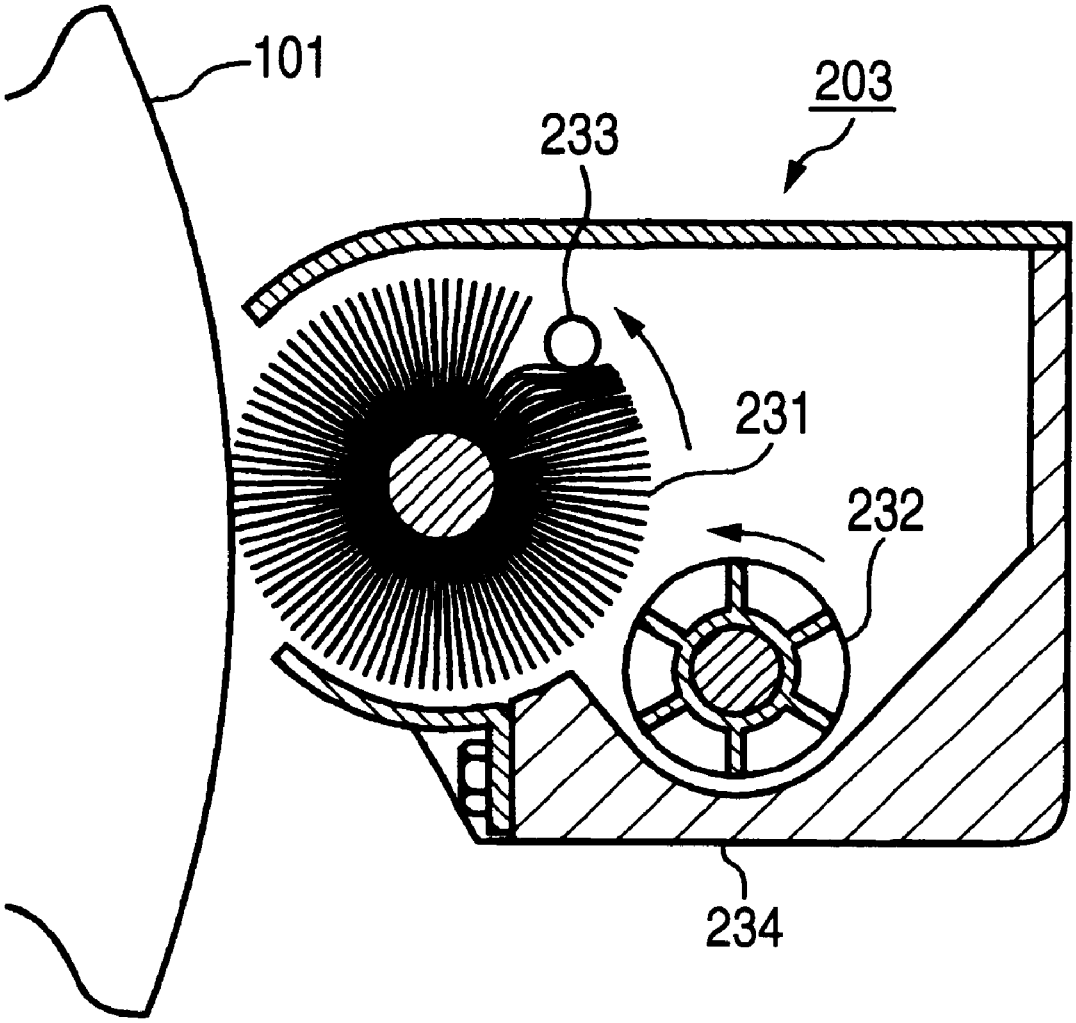
FIG. 4 is a schematic diagram showing a particulate supply unit of the image recording apparatus according to Embodiment 2 of the present invention.

FIG. 4 shows Embodiment 2 of the present invention. In Embodiment 2, particulate supply means is designed to be different from that in Embodiment 1.

In Embodiment 2, as shown in FIG. 4, a particulate supply unit 203 having a brush rotatable in contact with an image carrier 101 is used, in place of the particulate supply unit 103 provided in the image recording apparatus shown in FIG. 1. In this particulate supply unit 203, a rotary brush 231 is provided in an opening portion of a housing 234 for accommodating particulates, and a paddle 232 for supplying the particulates to the rotary brush 231 is provided at the rear of the rotary brush 231. The rotary brush 231 is driven to rotate so that bristle ends move in the same direction as the surface of the image carrier 101 in the portion where the rotary brush 231 abuts against the image carrier 101. The velocity of the rotary brush 231 is established so that the bristle ends move at a slightly higher velocity than the peripheral velocity of the image carrier 101. Particulates the same as those used in the apparatus shown in FIG. 1, that is, particulates surface-treated to be hydrophobic are accommodated in the particulate supply unit 203. Note that no carrier is mixed. The other configuration of this image recording apparatus, that is, the image carrier 101, a charger 102, an image writing unit 104, a developing unit 105, a transfer charger 106, a separating charger 107, a paper guide 109 and a conveying belt 110 used in this image recording apparatus are the same as those in the image recording apparatus shown in FIG. 1.

In such an image recording apparatus, the particulates accommodated in the housing 234 of the particulate supply unit 203 are sprinkled on the bristle ends of the rotary brush 231 by the paddle 232 so as to adhere thereto. Then, the particulates abut against a rod-like member 233 supported in parallel with the rotary brush 231 so that excessive particulates are brushed down. After that, the particulates are conveyed to a contact portion with the image carrier 101. In the contact portion, the bristle ends of the rotary brush 231 are rubbed against the surface of the image carrier 101 so that the particulates are attached thereto. At this time, large electric force does not act between the particulates and the image carrier 101, but the particle size is so small that non-electric adhesive force acts on the particulates strongly. Thus, the particulates adhere to the surface of the image carrier 101 so as to forma particulate layer. After that, the surface of the image carrier 101 is irradiated with image light from above this particulate layer so that a toner image is formed and transferred in the same manner as in the image recording apparatus shown in FIG. 1. Thus, a high transfer rate can be obtained.

EXAMPLE 2

The present inventors manufactured an image recording apparatus in FIG. 1 using a particulate supply unit as shown in FIG. 4, by way of trial. Then, experiments were carried out to investigate initial transfer residual density as an initial toner image transfer rate, and transfer residual density after transferring 10 thousand times. There was used an image carrier in which a hexamethyldisilazane solution in which 0.15 μm silica particulates were dispersed was applied onto an OPC photosensitive body. In addition, as the particulate supply unit, there was used one by which silica particulates (diameter 50 nm) the surfaces of which were subjected to oil treatment were supplied to the surface of the photosensitive drum 101.

As a result, it was proved that the initial transfer residual density showing the initial toner image transfer rate and the transfer residual density after transferring 10 thousand times were very low and satisfactory to be 0.03 and 0.05, respectively.

EXAMPLE 3

Further, the present inventors manufactured an image recording apparatus which uses the developing unit of FIG. 1 to serve also as a particulate supply unit without providing any special particulate supply unit, by way of trial. Then, experiments were carried out to investigate initial transfer residual density as an initial toner image transfer rate, and transfer residual density after transferring 10 thousand times. There was used an image carrier in which a hexamethyldisilazane solution in which 0.15 μm silica particulates were dispersed was applied onto an OPC photosensitive body. In addition, there was used a developer for the developing unit in which titania particulates and silica particulates (diameter 50 nm) the surfaces of which were subjected to oil treatment were mixed. Incidentally, as for the silica particulates the surfaces of which were subjected to oil treatment, the particle size was 50 nm, and the mixing weight ratio to toner was 0.5 wt %. As for the titania particulates, the particle size was 40 nm, and the mixing weight ratio to toner was 0.35 wt %.

As a result, the initial transfer residual density showing the initial toner image transfer rate was 0.05, and the transfer residual density after transferring 10 thousand times was 0.04 to be lower. Thus, it was proved that the titania particulates and the surface-oil-treated silica particulates dispersed in the developer of the developing unit were supplied gradually so that superior transfer property could be obtained also with the passage of time.

EXAMPLE 4

Furthermore, the present inventors manufactured an image recording apparatus shown in FIG. 1 by way of trial.

The image recording apparatus was provided with not only the particulate supply means shown in FIG. 4 but also particulate supply means shown in FIG. 4 in which no particulates were accommodated, that is, which functioned as particulate smoothing means. Then, experiments were carried out to investigate initial transfer residual density as an initial toner image transfer rate, and transfer residual density after transferring 10 thousand times. There was used an image carrier in which a hexamethyldisilazane solution in which 0.15 $\mu$m silica particulates were dispersed was applied onto an OPC photosensitive body. In addition, there was used a particulate supply unit shown in FIG. 4 in which no particulates were accommodated, that is, which functioned as particulate smoothing means. In addition, as the particulates on the OPC photosensitive body, silica particulates (particle size 50 nm) the surfaces of which were subjected to oil treatment were supplied. A brush of the particulate smoothing means had a resistance of $10^{10}$ Ωcm. The brush was rotated at a velocity (peripheral velocity) 1.5 times as high as that of the OPC photosensitive body. Incidentally, experiments were also carried out using brushes having resistances of $10^{6}$ Ωcm, $10^{13}$ Ωcm, $10^{5}$ Ωcm, and $10^{14}$ Ωcm, as the brush of the particulate smoothing means.

As a result, when the brush having a resistance of $10^{10}$ Ωcm was used as the brush of the particulate smoothing means, the initial transfer residual density showing the initial toner image transfer rate, and the transfer residual density after transferring 10 thousand times were low to be 0.01 and 0.03 respectively. Thus, it was proved that superior transfer property could be obtained also with the passage of time. Also when the brushes having resistances of $10^{5}$ Ωcm and $10^{13}$ Ωcm were used as the brushes of the particulate smoothing means, the initial transfer residual density showing the initial toner image transfer rate, and the transfer residual density after transferring 10 thousand times were low to be 0.01 and 0.03 respectively. Thus, it was proved that superior transfer property could be obtained also with the passage of time. However, when the brushes having resistances of $10^{5}$ Ωcm and $10^{14}$ Ωcm were used as the brushes of the particulate smoothing means, there was an image defect initially. Thus, it was proved that the brushes were not suitable.

EXAMPLE 5

Further, the present inventors manufactured an image recording apparatus in FIG. 1 by way of trial. The image recording apparatus used a particulate supply unit as shown in FIG. 4, but an elastic roll was used in place of the brush. Then, experiments were carried out to investigate initial transfer residual density as an initial toner image transfer rate, and transfer residual density after transferring 10 thousand times. There was used an image carrier in which a hexamethyldisilazane solution in which 0.15 $\mu$m silica particulates were dispersed was applied onto an OPC photosensitive body. In addition, there was used a particulate supply unit in which silica particulates (diameter 50 nm) the surfaces of which were subjected to oil treatment were supplied to the surface of the photosensitive drum 101. In addition, the surface material of the elastic roll was PVDF based on carbon dispersion, and the resistance of the surface material was $10^{10}$ Ωcm. The elastic roll was rotated at a velocity (peripheral velocity) 1.1 times as high as that of the OPC photosensitive body. Incidentally, experiments were also carried out using rolls having resistances of $10^{6}$ Ωcm, $10^{13}$ Ωcm, $10^{5}$ Ωcm, and $10^{14}$ Ωcm, as the rolls of the particulate smoothing means.

As a result, when the roll having a resistance of $10^{10}$ Ωcm was used as the roll of the particulate supply unit, the initial transfer residual density showing the initial toner image transfer rate, and the transfer residual density after transferring 10 thousand times were low to be 0.02 and 0.05 respectively. Thus, it was proved that superior transfer property could be obtained also with the passage of time. Also when the rolls having resistances of $10^{6}$ Ωcm and $10^{13}$ Ωcm were used as the rolls of the particulate supply units, the initial transfer residual density showing the initial toner image transfer rate, and the transfer residual density after transferring 10 thousand times were low to be 0.02 and 0.04 respectively. Thus, it was proved that superior transfer property could be obtained also with the passage of time. However, when the rolls having resistances of $10^{5}$ Ωcm and $10^{14}$ Ωcm were used as the rolls of the particulate supply units, there was an image defect initially. Thus, it was proved that the rolls were not suitable.

EXAMPLE 6

Furthermore, the present inventors manufactured an image recording apparatus by way of trial. The image recording apparatus did not use the particulate supply means shown in FIG. 4 but used the one in which abrasive particulates were contained in the developer of the developing unit shown in FIG. 1. Then, experiments were carried out to investigate initial transfer residual density as an initial toner image transfer rate, and transfer residual density after transferring 10 thousand times. There was used an image carrier in which a hexamethyldisilazane solution in which 0.15 $\mu$m silica particulates were dispersed was applied onto an OPC photosensitive body. In addition, there was used a developer in which cerium oxide having a particle size of 0.65 $\mu$m was contained as the abrasive particulates (weight ratio to toner 0.5 wt %). In addition, as the particulates on the OPC photosensitive body, silica particulates (particle size 50 nm) the surfaces of which were subjected to oil treatment were supplied. Further, there was used toner in which silica particulates (particle size 50 nm) the surfaces of which were subjected to oil treatment were mixed at the weight ratio to toner of 0.5 wt % likewise, and titania particulates (particle size 40 nm) were mixed at the weight ratio to toner of 0.35 wt %.

As a result, the initial transfer residual density showing the initial toner image transfer rate, and the transfer residual density after transferring 10 thousand times were very low to be 0.01 and 0.02 respectively. Thus, it was proved that superior transfer property could be obtained also with the passage of time.

Embodiment 3

Figure 5:
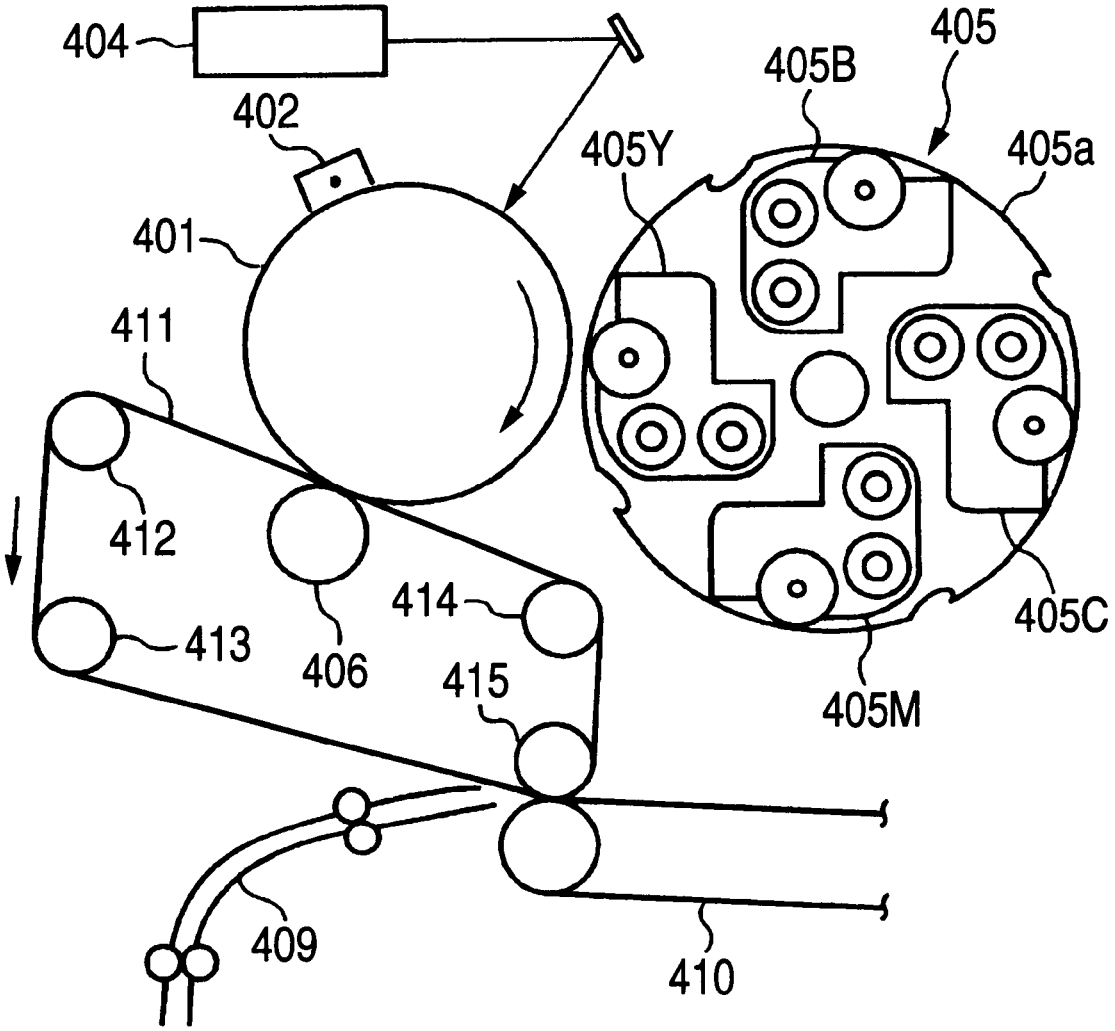
FIG. 5 is a schematic diagram showing an image recording apparatus according to Embodiment 3 of the present invention.

FIG. 5 shows Embodiment 3 of the present invention. In Embodiment 3, a toner image formed on an image carrier is not transferred directly onto a recording medium. Primary transfer is carried out in the state where different color toner images formed sequentially on the image carrier are put on top of one another on an intermediate transferor. After the primary transfer, secondary transfer is carried out so that the toner images transferred onto the intermediate transferor are transferred onto the recording medium in a lump.

This image recording apparatus forms a full-color image. The image recording apparatus has a photosensitive drum 401, a charger 402, an image writing unit 404, four developing units 405Y, 405M, 405C and 405K, an intermediate transfer belt 411 like an endless belt, a transfer roll 406, a second transfer roll 415, and a conveying belt 410. The photosensitive drum 401 has a photosensitive layer on the surface. The charger 402 charges the photosensitive drum 401 uniformly. The image writing unit 404 irradiates the uniformly charged photosensitive drum 401 with image light so as to form an electrostatic latent image on the surface of the photosensitive drum 401. The developing units 405Y, 405M, 405C and 405K accommodate yellow, magenta, cyan and black developers respectively. The intermediate transfer belt 411 is laid to be able to go round by a plurality of rollers 412, 413, 414 and 415 while brought into contact with the photosensitive drum 401. The transfer roll 406 transfers a toner image formed on the surface of the photosensitive drum 401 to the intermediate transfer belt 411. The second transfer roll 415 transfers the toner image on the intermediate transfer belt 411 to recording paper conveyed along a paper guide 409. The conveying belt 410 conveys the recording paper to which the toner image has been transferred.

The four developing units 405Y, 405M, 405C and 405K are supported by one base portion 405*a* driven to rotate. The developing units 405Y, 405M, 405C and 405K come close to and opposite to the photosensitive drum 401 sequentially so that toners are transferred to latent images corresponding to the respective colors so as to form visible images (toner images). The following developers are used in the developing units. Carriers are the same as those used in the image recording apparatus shown in FIG. 1. The toners have the same binder and the same average particle size, but different pigments are used for the toners respectively. In addition, silica impalpable powder with a particle size of 50 nm is used as an external additive, and mixed so that the coating rate over the toner reaches 50%.

The intermediate transfer belt 411 is a 135 $\mu$m thick endless belt in which carbon black has been dispersed into polycarbonate resin. The electric resistance value of the intermediate transfer belt 411 is in a range of from $10^8$ Ω to $10^9$ Ω. The intermediate transfer belt 411 and the photosensitive drum 401 are driven at a peripheral velocity of 160 mm/s in the directions shown by the arrows in the drawing, respectively. These members are not provided with any cleaning unit.

This image recording apparatus uses an initial cycle of the photosensitive drum 401 as a dummy mode for the yellow developing unit, and thereafter forms toner images of the respective colors on the photosensitive drum 401 sequentially. Then, the toner images are put on top of one another on the intermediate transfer belt 411, and transferred thereto. The image recording apparatus operates as follows. The photosensitive drum 401 is driven to rotate, and charged uniformly by the charger 402. After that, the photosensitive drum 401 moves to the position opposite to the yellow developing unit 405Y without undergoing image exposure. Here, silica impalpable powder is transferred substantially uniformly. The surface of the silica impalpable powder has been treated to be hydrophobic in the same manner as that in Embodiment 1. After that, the photosensitive drum 401 is irradiated with image light from above this particulate layer so that a latent image is formed. This latent image is visualized by the yellow developing unit 405Y, and the toner image is transferred onto the intermediate transfer belt 411 by the transfer roll 406. At this time, since the toner image is formed on the particulate layer, the toner image is transferred at an efficiency close to 100%.

The photosensitive drum 401 further undergoes the respective steps of charging by the charger 402, irradiating with image light, forming a toner image, and transferring the toner image to the intermediate transfer belt 411, for the respective colors of cyan, magenta and black. Thus, a full-color image in which the toner images of the four colors have been put on top of one another is formed on the intermediate transfer belt 411. This full-color toner image is transferred to recording paper in a lump by the second transfer roll 415. Thus, a full-color recorded image is obtained. In such an image recording apparatus, an excellent full-color image can be formed without providing any cleaning unit and without recovering residual toner on the photosensitive drum 401.

Incidentally, in this apparatus, apart of the particulates transferred from the developing units 405Y, 405M, 405C and 405K to the photosensitive drum 401 are transferred onto the intermediate transfer belt 411 so as to form a particulate layer on the intermediate transfer belt 411. Thus, the transfer efficiency from the intermediate transfer belt 411 to the recording paper is also improved. However, if the improved transfer efficiency is not satisfactory, a particulate supply unit for supplying particulates onto the surface of the intermediate transfer belt 411 may be provided. Incidentally, in this case, the surface of the intermediate transfer belt 411 should be formed of a material having a high affinity to the particulates the surfaces of which have been treated to be hydrophobic.

EXAMPLE 7

Next, the present inventors manufactured an image recording apparatus as shown in FIG. 5, by way of trial. Then, experiments were carried out to investigate initial transfer residual density as an initial toner image transfer rate, and transfer residual density after transferring 10 thousand times. The image recording apparatus put in service had the following properties.

- photosensitive body: OPC (ϕ84 mm)
- image writing unit: laser ROS (600 dpi)
- process rate: 160 mm/s
- latent image potential:
  - background portion −550V
  - image portion −150V
- developing roll: fixed magnet and rotary sleeve system
- magnet magnetic flux density: 500 G (on sleeve)
- sleeve diameter: ϕ25 mm
- sleeve rotational velocity: 300 mm/s
- distance between photosensitive body and developing roll (DRS): 0.5 mm
- distance between developer regulating member and developing roll: 0.5 mm
- developing bias:
  - DC component −500V
  - AC component 1.5 kVp-p (8 kHz)
- toner:
  - 5 wt % carbon black dispersed in polyester
  - toner grain size 7.5 $\mu$m
  - tribology 25 $\mu$C/g
- intermediate transfer belt: 135 $\mu$m thick carbon black dispersed in polyimide
- primary transfer voltage: 400 V
- secondary transfer voltage: 2,000 V A hexamethyldisilazane solution in which 0.15 $\mu$m silica particulates had been dispersed was applied onto the intermediate transfer belt 411 arranged thus. In addition, 0.15 $\mu$m silica particulates were dispersed into solutions of other hydrophobic treatment agents different in SP value, and the solutions were applied onto the intermediate transfer belt 411 respectively.

As a result, when the material of the belt surface was changed, the difference in SP value between the material and the particulates was changed. Then, it was proved that, when the difference in SP value was 0, the initial transfer residual density showing the initial toner image transfer rate, and the transfer residual density after transferring 10 thousand times were very low and satisfactory to be 0.01 and 0.04 respectively. In addition, it was proved that when the difference in SP value was 0.9 or 1.1, the initial transfer residual density showing the initial toner image transfer rate was 0.01 in either case, and the transfer residual density after transferring 10 thousand times was very low and satisfactory to be 0.04 or 0.05. However, when the difference in SP value went beyond 1.1 and reached 1.3, the initial transfer residual density showing the initial toner image transfer rate was satisfactory to be 0.01, but the transfer residual density after transferring 10 thousand times increased to 0.10. Thus, it was proved that the transfer efficiency was degraded.

This reason is considered as follows. If the difference in SP value between the material of the belt surface and the particulates became large, the tenability of the particulates on the belt surface was lowered gradually so that the particulate layer on the belt surface was reduced. Thus, the transfer efficiency was degraded.

It was thus proved that the difference in SP value between the surface of the image carrier or the intermediate transferor and the particulates had to be limited to 1.1 or less in order to ensure a high initial toner image transfer rate and in order to keep a high transfer rate for a long time.

EXAMPLE 8

Next, the present inventors manufactured an image recording apparatus as shown in FIG. 5, by way of trial. Then, experiments were carried out to investigate the relationship between the thickness of the particulate layer and the toner image transfer property.

Silica particulates having a particle size of 0.15 $\mu$m were dispersed into a hexamethyldisilazane solution, and the solution was applied onto the intermediate transfer belt 411. The coated intermediate transfer belt 411 was dried. After that, various test pieces were prepared to be different in the thickness of the particulate layer so that the maximum thickness of the particulate layer reached 10 $\mu$m.

As for the conditions to estimate the transfer property, development was carried out at about 6 mg/cm$^2$ in solid image on paper, and the transfer rate at that time and the transferred image quality of a 30% half tone image were estimated visually. For the sake of simplification, toner remaining on the intermediate transfer belt 411 was transferred onto a tape, and the toner density was measured as the transfer rate (eliminating the tape density).

Figure 6:
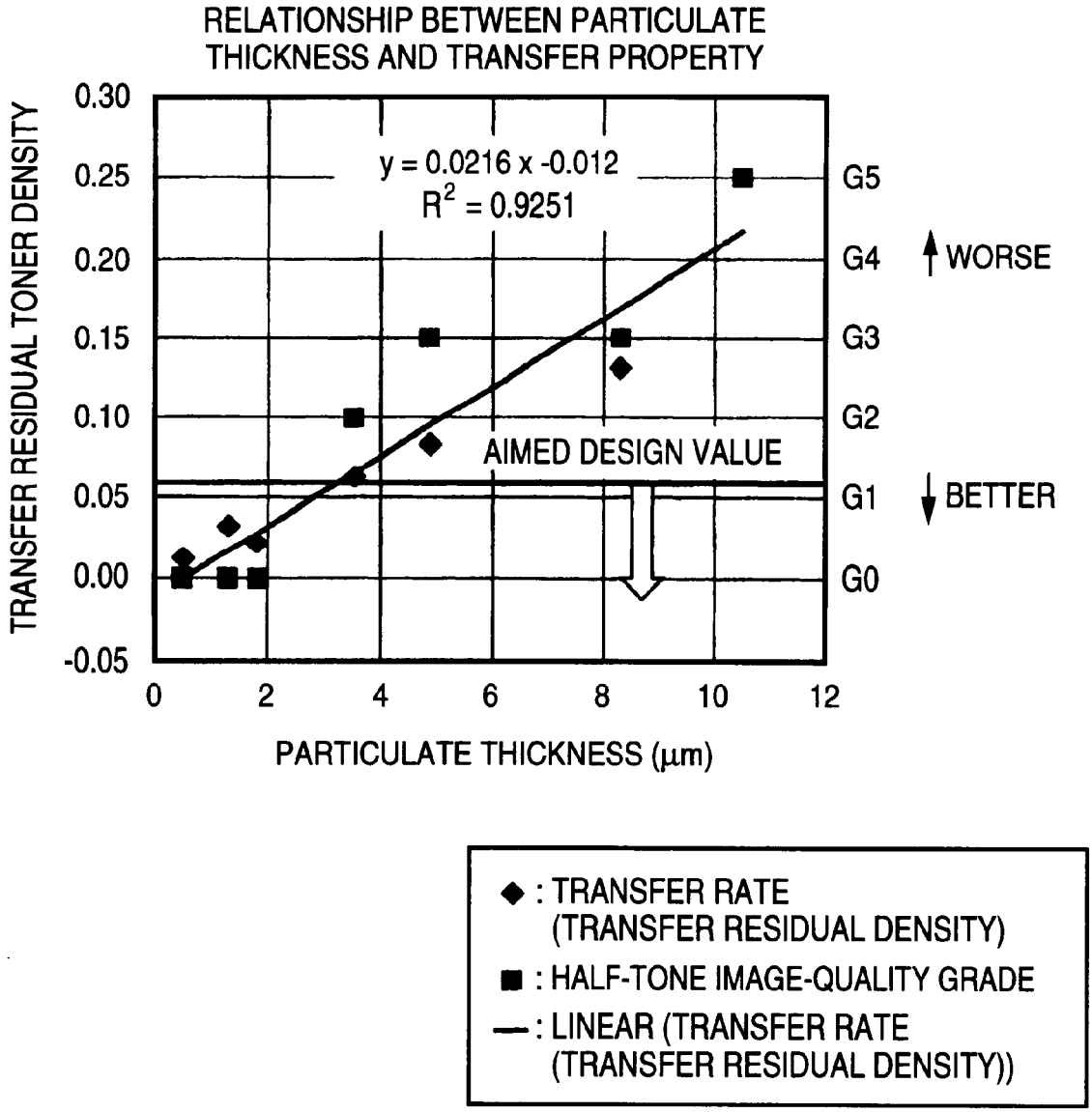
FIG. 6 is a graph showing the relationship between the thickness of a particulate layer and the transfer residual toner density.

FIG. 6 shows the results of the above-mentioned experiments.

As is apparent from FIG. 6, it was proved that in order to suppress the transfer residual toner density to be not larger than 0.06 which was an aimed value on design, it was desired that the thickness of the particulate layer was not larger than 3 $\mu$m.

Embodiment 4

Figure 7:
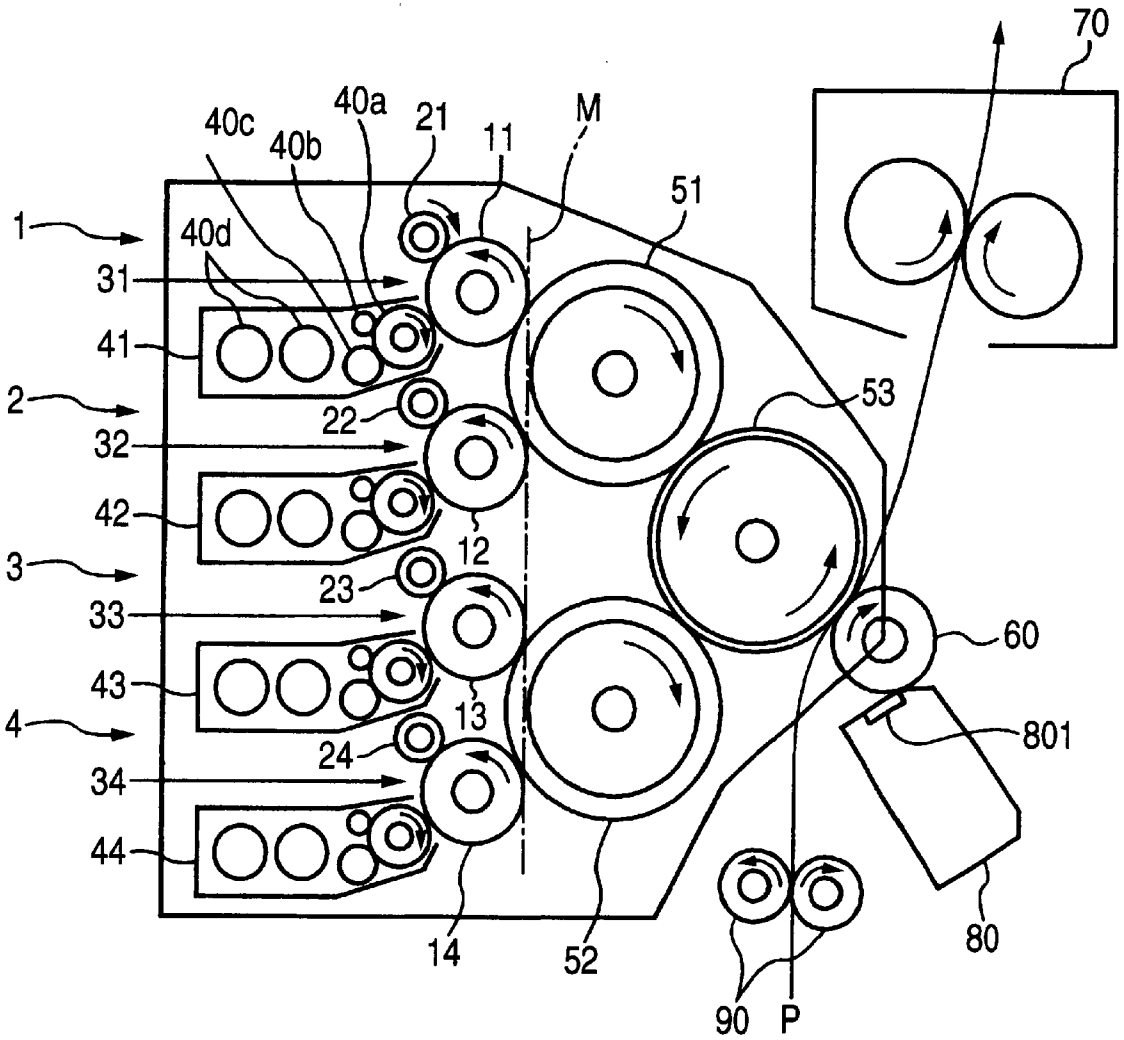
FIG. 7 is a schematic diagram showing an image recording apparatus according to Embodiment 4 of the present invention.

FIG. 7 shows Embodiment 4 of the present invention. In Embodiment 4, there are provided a plurality of image carriers on which toner images different in color are formed. The plurality of color toner images formed on the image carriers are not transferred directly onto a recording medium. Of the different color toner images formed sequentially on the image carriers, different color toner images formed on two of the image carriers are put on top of each other on a first primary intermediate transferor, so that primary transfer is carried out in that state. At the same time, different color toner images formed on the other two of the image carriers are put on top of each other on a second primary intermediate transferor, so that primary transfer is carried out in that state. After that, the primary-transferred toner images put on top of each other on the first and second primary transferor respectively are put on top of each other on a secondary intermediate transferor, so that secondary transfer is carried out in that state. Further, the secondary-transferred toner images put on top of each other on the secondary intermediate transferor are tertiary-transferred in a lump onto a recording paper.

As shown in FIG. 7, the main portion of this image recording apparatus is constituted by image forming units 1, 2, 3 and 4 having photosensitive drums (image carriers) 11, 12, 13 and 14 for yellow (Y), magenta (M), cyan (C) and black (K) respectively; charging rolls (contact type charging units) 21, 22, 23 and 24 for primary charging in contact with the photosensitive drums 11, 12, 13 and 14 respectively; a not-shown ROS (exposure unit) for irradiating laser beams 31, 32, 33 and 34 for the respective colors of yellow (Y), magenta (M), cyan (C) and black (K); developing units 41, 42, 43 and 44 for developing electrostatic latent images formed on the photosensitive drums 11, 12, 13 and 14 with toners of the respective colors of yellow (Y), magenta (M), cyan (C) and black (K); a first primary intermediate transfer drum (intermediate transferor) 51 in contact with the two photosensitive drums 11 and 12 of the four photosensitive drums 11, 12, 13 and 14; a second primary intermediate transfer drum (intermediate transferor) 52 in contact with the other two photosensitive drums 13 and 14; a secondary intermediate transfer drum (intermediate transferor) 53 in contact with the first and second primary intermediate transfer drums 51 and 52; and a final transfer roll (transfer member) 60 in contact with the secondary intermediate transfer drum 53.

The photosensitive drums 11, 12, 13 and 14 are disposed at predetermined intervals so as to have a common tangent plane M. In addition, the first and second primary intermediate transfer drums 51 and 52 are disposed so that the rotation axes thereof are parallel to the axes of the photosensitive drums 11, 12, 13 and 14 and have a relationship of plane symmetry with respect to a predetermined plane of symmetry. Further, the secondary intermediate transfer drum 53 is disposed so that the rotation axis thereof is parallel to the rotation axes of the photosensitive drums 11, 12, 13 and 14.

Signals in response to image information for every color are rasterized by a not-shown image processing unit and supplied to a not-shown laser optical unit. In this laser optical unit, laser beams 31, 32, 33 and 34 of the respective colors of cyan (C), magenta (M), yellow (Y) and black (K) are modulated on the basis of the image information for every color, and the color photosensitive drums 11, 12, 13 and 14 are irradiated with the laser beams 31, 32, 33, and 34 correspondingly.

Around the photosensitive drums 11, 12, 13 and 14, an image forming process based on a known electrophotographic system is executed for every color. First, for example, a photosensitive drum using an OPC photosensitive body of a diameter of 20 mm is used as each of the photosensitive drums 11, 12, 13 and 14. These photosensitive drums 11, 12, 13 and 14 are driven to rotate, for example, at a rotational velocity of surface velocity of 95 mm/sec by a drive unit of a body of revolution which will be described later. As shown in FIG. 7, a DC voltage of about −840 V is applied to the charging rolls 12, 22, 32 and 42 as contact type charging units, so that the surfaces of the photosensitive drums 11, 12, 13 and 14 are charged to, for example, about −300 V. Incidentally, as the contact type charging units, there may include rotor type ones, film type ones, brush type ones, and so on, but charging units of any type may be used. In this embodiment, there are adopted charging rolls which have been generally used in electrophotographic apparatus in recent years. In addition, although a charging system for applying only DC is adopted to charge the surfaces of the photosensitive drums 11, 12, 13 and 14 in this embodiment, a charging system for applying AC and DC may be used.

After that, the surfaces of the photosensitive drums 11, 12, 13 and 14 are irradiated with the laser beams 31, 32, 33 and 34 corresponding to the respective colors of cyan (C), magenta (M), yellow (Y) and black (K) by the not-shown laser optical unit as an exposure unit. Thus, electrostatic latent images in response to input image information of the respective colors are formed. When the electrostatic latent images are written in the photosensitive drums 11, 12, 13 and 14 by the laser optical unit, the surface potentials of the image exposure portions of the photosensitive drums 11, 12, 13 and 14 are destaticized to, for example, about −60 V or less.

In addition, the electrostatic latent images corresponding to the respective colors of cyan (C), magenta (M), yellow (Y) and black (K) formed in the surfaces of the photosensitive drums 11, 12, 13 and 14 are developed by the corresponding color developing units 41, 42, 43 and 44 respectively. Thus, the electrostatic latent images are visualized as toner images of the respective colors of cyan (C), magenta (M), yellow (Y) and black (K) on the respective photosensitive drums 11, 12, 13 and 14.

Although a magnetic brush contact type two-component development system is adopted for the developing units 41, 42, 43 and 44 in this embodiment, the scope of application of the present invention is not limited to such a development system. Not to say, the present invention is satisfactorily applicable also to other development systems such as a non-contact type development system, and so on.

The developing units 41, 42, 43 and 44 are filled with developers composed of different color toners of cyan (C), magenta (M), yellow (Y) and black (K), and carriers, respectively If toner is supplied from a not-shown toner supply unit to the developing unit 41, 42, 43 or 44, the supplied toner is stirred with the carriers sufficiently by an auger 40*d* so as to be tribo-charged. Inside a developing roll 40*a*, a magnet roll (not shown) in which a plurality of magnetic poles are disposed at predetermined angles is fixedly disposed. The developer conveyed to the vicinity of the surface of the developing roll 40*a* by a paddle 40*b* for conveying the developer to the developing roll 40*a* is regulated in quantity to be conveyed to the developing portion by a developer quantity regulating member 40*b*. In this embodiment, the quantity of the developer is in a range of from 30 g/m$^2$ to 50 g/m$^2$. In addition, the charging quantity of the toner existing on the developing roll 40*a* at this time is approximately in a range of from −20 $\mu$C/g to 35 $\mu$C/g.

The toner supplied onto the developing roll 40*a* is formed into a magnetic brush constituted by the carriers and the toner by the magnetic force of the magnet roll. This magnetic brush abuts against the photosensitive drum 11, 12, 13 or 14. An AC and DC development bias voltage is applied to the developing roll 40*a* so that the toner on the developing roll 40*a* is developed on the electrostatic latent image formed on the photosensitive drum 11, 12, 13 or 14. Thus, a toner image is formed. In this embodiment, AC of the development bias voltage has 4 kHz and 1.5 kVpp, and DC thereof is about −230 V.

Incidentally, this embodiment is designed to have particulate supply means for supplying particulates smaller in particle size than the toner to the surface of the image carrier. However, the particulate supply means is designed to be constituted by developing means for supplying the particulates at the same time as development.

That is, in this embodiment, a layer of particulates the surfaces of which have been initially treated to be hydrophobic is formed uniformly on the surface of each of the photosensitive drums 11, 12, 13 and 14, the first and second primary intermediate transfer drums 51 and 52, and the secondary intermediate transfer drum 53 in the same manner as that in Embodiment 1. However, there is a case that with the step of transferring a toner image, a part of the particulates retained on each of the photosensitive drums 11, 12, 13 and 14, the first and second primary intermediate transfer drums 51 and 52, and the secondary intermediate transfer drum 53 is transferred onto another intermediate transfer drum or recording paper together with the toner image so as to be detached.

Therefore, by the developing units 41, 42, 43 and 44, particulates are subsidiarily supplied to the surfaces of the photosensitive drums 11, 12, 13 and 14 and so on from which a part of the particulates have been detached. To this end, particulates of predetermined density as well as toner are accommodated inside the developing units 41, 42, 43 and 44. In the step of supplying particulates before the developing step, particulates are transferred from the developing units 41, 42, 43 and 44 to the surfaces of the photosensitive drums 11, 12, 13 and 14, particularly to the surfaces of the photosensitive drums 11, 12, 13 and 14 from which a part of particulates have been detached. Thus, uniform particulate layers can be kept for a long time.

In addition, this embodiment is designed to provide particulate smoothing means for uniformly smoothing the particulates which are smaller in particle size than the toner and which have been supplied to the surface of the image carrier.

The particulate smoothing means, for example, is constituted by a rotatable brush. This rotatable brush is, for example, a conductive brush, which is designed to have a volume resistivity in a range of from $10^6$ Ωcm to $10^{13}$ Ωcm, to be supplied with a bias voltage in a range of from −1,000 V to +1,000 V, and to have a difference in velocity from the image carrier.

Alternatively, the particulate smoothing means may be constituted by a rotatable roll or an endless belt in place of the rotatable brush. The rotatable roll or the endless belt is a conductive roll or a conductive endless belt brush, which is designed to have a volume resistivity in a range of from $10^6$ Ωcm to $10^{13}$ Ωcm, to be supplied with a bias voltage in a range of from −1,000 V to +1,000 V, and to have a difference in velocity from the image carrier.

In this embodiment, as the particulate smoothing means, there is used a temporarily cleaning unit called a refresher for temporarily cleaning the surfaces of the photosensitive drums 11, 12, 13 and 14, the first and second primary intermediate transfer drums 51 and 52, and the secondary intermediate transfer drum 53. This temporarily cleaning unit is constituted by a rotary brush which scrapes a very small quantity of residual toner on the surfaces of the photosensitive drums 11, 12, 13 and 14, and so on, so as to remove the residual toner. This rotatable brush is, for example, a conductive brush, which is designed to have a volume resistivity in a range of from $10^6$ Ωcm to $10^{13}$ Ωcm, preferably in a range of from $10^7$ Ωcm to $10^9$ Ωcm, to be supplied with a bias voltage in a range of from −1,000 V to +1,000 V, preferably in a range of from +100 V to +400 V, and to be driven to rotate with a difference in velocity from the surfaces of the photosensitive drums 11, 12, 13 and 14, and so on.

In addition, the particulate smoothing means may be constituted by a charging roll which is a contact type charger and which has a difference in velocity from the image carrier. Alternatively, the particulate smoothing means may be constituted by charging/cleaning means for abutting against the surface of the image carrier so as to charge the surface of the image carrier while cleaning the surface of the image carrier and smoothing the particulates. In this case, the charging/cleaning means has a difference in velocity from the image carrier. Further, the particulate smoothing means may be constituted by charging/temporarily-cleaning means for abutting against the surface of the image carrier so as to charge the surface of the image carrier while temporarily cleaning the surface of the image carrier and smoothing the particulates. In this case, the charging/cleaning means has a difference in velocity from the image carrier.

Furthermore, the particulate smoothing means may be constituted by either an image carrier or an intermediate transferor abutting against each other, with a difference in velocity between the image carrier and the intermediate transferor. In this case, for example, a velocity difference of about 1% is established between the image carrier and the intermediate transferor abutting against each other.

Moreover, the particulate smoothing means may be constituted by a final transfer roll 60 as transfer means for abutting against the surface of the image carrier or the intermediate transferor so as to transfer a toner image formed on the surface of the image carrier or the intermediate transferor to a recording medium. In this case, the final transfer roll 60 has a difference in velocity from the image carrier or the intermediate transferor.

In addition, in this embodiment, abrasive particulates are contained in the developers in the developing units 41, 42, 43 and 44. As the abrasive particulates, inorganic metal oxides are chiefly used. Examples of such inorganic metal oxides include silicon carbide, titanium oxide, alumina, calcium carbonate, magnesium carbonate, magnesium phosphate, cerium oxide, etc.

Next, the toner images of the respective colors of cyan (C), magenta (M), yellow (Y) and black (K) formed on the photosensitive drums 11, 12, 13 and 14 are electrostatically primary-transferred onto the first and second primary intermediate transfer drums 51 and 52. The toner images of the colors of cyan (C) and magenta (M) formed on the photosensitive drums 11 and 12 are transferred onto the first primary intermediate transfer drum 51. The toner images of the colors of yellow (Y) and black (K) formed on the photosensitive drums 13 and 14 are transferred onto the second primary intermediate transfer drum 52. Thus, a unicolor image transferred from the photosensitive drum 11 or 12, and a two-color image in which toner images of two colors transferred from both the photosensitive drums 11 and 12 have been put on top of each other, are formed on the first primary intermediate transfer drum 51. On the other hand, a unicolor image and a two-color image from the photosensitive drums 13 and 14 are formed likewise on the second primary intermediate transfer drum 52.

The surface potential required for electrostatically transferring toner images from the photosensitive drums 11, 12, 13 and 14 onto the first and second primary intermediate transfer drums 51 and 52 is approximately in a range of from +250 V to +500 V. This surface potential is set to an optimum value in accordance with the charging state of toner, the atmospheric temperature, or the humidity. The atmospheric temperature or the humidity can be known easily by detecting the resistance value of a member having a property that the resistance value varies in accordance with the atmospheric temperature or the humidity. As described above, when the charging quantity of the toner is in a range of from −20 μC/g to 35 μC/g, and under the environment of room temperature and normal humidity, it is desired that the surface potential of each of the first and second primary intermediate transfer drums 51 and 52 is about +380 V.

Figure 8:
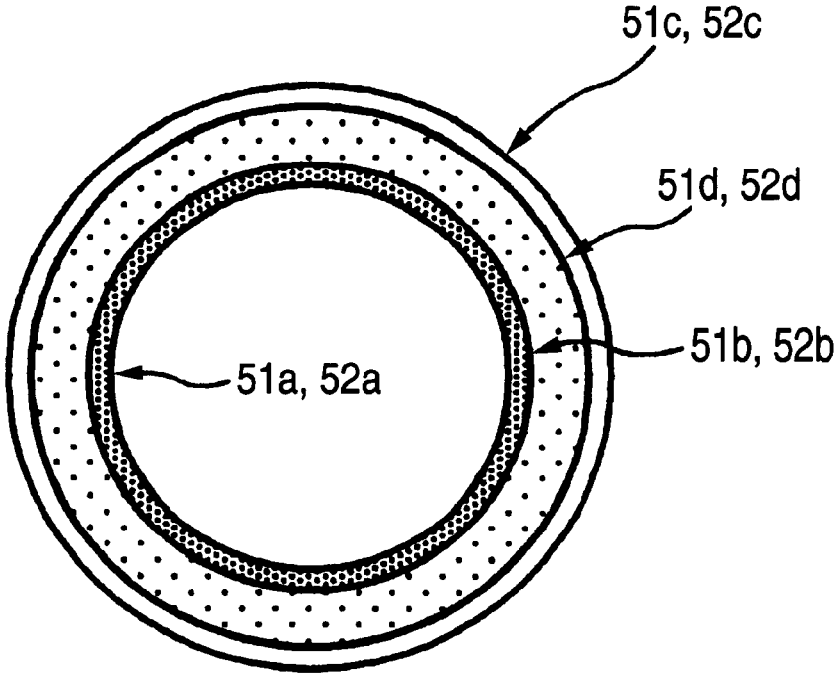
FIG. 8 is a schematic sectional view showing an intermediate transfer drum.

For example, each of the first and second primary intermediate transfer drums 51 and 52 used in this embodiment is formed to have an outer diameter of 42 mm, and the resistance value is established to be about $10^8$ Ω. Each of the first and second primary intermediate transfer drums 51 and 52 is a cylindrical body of revolution, which is constituted by a single layer or a plurality of layers and the surface of which has flexibility or elasticity. Generally, as shown in FIG. 8, low-resistance elastic rubber layers 51*b* and 52*b* ($R=10^2$ to $10^3$ Ω) represented by conductive silicon rubber or the like, having a thickness of about 0.1 to 10 mm, are provided on metal pipes 51*a* and 52*a* as metal cores constituted by Fe, Al or the like, respectively. Further, in the outermost surfaces of the first and second intermediate transfer drums 51 and 52, typically, fluoro-rubber in which fluoro-resin particulates have been dispersed is formed as high-releasable layers 51*c* and 52*c* ($R=10^5$ to $10^9$ Ω) 3 to 100 μm thick, and bonded by bonding agents 51*d* and 52*d* (primers) of silane coupling agents. Here, the resistance value and the surface releasability are important. There is no special limit in material so long as the material of the high-releasable layers has a resistance value of about $R=10^5$ to $10^9$ Ω, and high releasability.

In such a manner, the unicolor or two-color toner images formed on the first and second primary intermediate transfer drums 51 and 52 are electrostatically secondary-transferred onto the secondary intermediate transfer drum 53. Thus, final toner images from unicolor images to a four-color image of cyan (C), magenta (M), yellow (Y) and black (K) are formed on the secondary intermediate transfer drum 53.

The surface potential required for electrostatically transferring toner images from the first and second primary intermediate transfer drums 51 and 52 onto the secondary intermediate transfer drum 53 is approximately in a range of from +600 V to +1,200 V. This surface potential is set to an optimum value in accordance with the charging state of toner, the atmospheric temperature, or the humidity, in the same manner as when toner images are transferred from the photosensitive drums 11, 12, 13 and 14 to the first and second primary intermediate transfer drums 51 and 52. Since a difference in potential between the first and second primary intermediate transfer drums 51 and 52 and the secondary intermediate transfer drum 53 is required for transfer, it is necessary to set the surface potential of the secondary intermediate transfer drum 53 to take a value in accordance with the surface potential of the first and second primary intermediate transfer drums 51 and 52. As described above, when the charging quantity of the toner is in a range of from −20 μC/g to 35 μC/g, under the environment of room temperature and normal humidity, and when the surface potential of the first and second primary intermediate transfer drums 51 and 52 is about +380 V, it is desired that the surface potential of the secondary intermediate transfer drum 53 is set to be about +880 V, that is, the difference in potential between the first and second primary intermediate transfer drums 51 and 52 and the secondary intermediate transfer drum 53 is set to be about +500 V.

For example, the secondary intermediate transfer drum 53 used in this embodiment is formed to have an outer diameter of 42 mm as large as that of each of the first and second primary intermediate transfer drums 51 and 52, and the resistance value is established to be about $10^{11}$ Ω. In addition, the secondary intermediate transfer drum 53 is a cylindrical body of revolution, which is constituted by a single layer or a plurality of layers and the surface of which has flexibility or elasticity, in the same manner as the first and second primary intermediate transfer drums 51 and 52. Generally, a low-resistance elastic rubber layer ($R=10^2$ to $10^3$ Ω) represented by conductive silicon rubber or the like, about 0.1 to 10 mm thick, is provided on a metal pipe as a metal core composed of Fe, Al or the like. Further, in the outermost surface of the secondary intermediate transfer drum 53, typically, fluoro-rubber in which fluoro-resin particulates have been dispersed is formed as a high-releasable layer 3 to 100 μm thick, and bonded by a bonding agent (primer) of a silane coupling agent. Here, the resistance value of the secondary intermediate transfer drum 53 has to be set to be higher than that of each of the first and second primary intermediate transfer drums 51 and 52. If not so, the secondary intermediate transfer drum 53 would charge the first and second primary intermediate transfer drums 51 and 52 so as to make it difficult to control the surface potential of the first and second primary intermediate transfer drums 51 and 52. There is no special limit in material if the material satisfies such conditions.

Next, the final toner images from unicolor images to a four-color image formed on the secondary intermediate transfer drum 53 are tertiary-transferred to paper passing through a paper conveying path P by the final transfer roll 60. This paper passes through a paper conveying roll 90 through a not-shown paper feeding step, so as to be fed into a nip portion between the secondary intermediate transfer drum 53 and the final transfer roll 60. After this final transfer step, a final toner image formed on the paper is fixed by a fixing unit 70. Thus, a series of image forming processes are completed.

Figure 9:
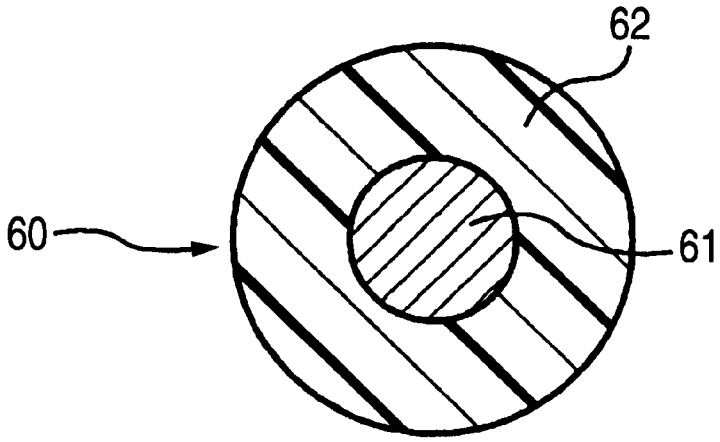
FIG. 9 is a schematic sectional view showing a final transfer roll.

For example, the final transfer roll 60 is formed to have an outer diameter of 20 mm, and the resistance value is established to be about $10^8$ Ω. The final transfer roll 60 is formed so that a coating layer 62 composed of urethane rubber or the like is provided on a metal shaft 61, and coating is given thereon in accordance with necessity, as shown in FIG. 9. The optimum value of a voltage applied to the final transfer roll 60 varies in accordance with the atmospheric temperature, the humidity, the kind of paper (resistance value or the like), and so on. The optimum value is generally approximately in a range of from +1,200 V to +5,000 V. In this embodiment, a constant current system is adopted, and a current of about +6 μA is applied under the environment of room temperature and normal humidity, so as to obtain a substantially correct transfer voltage (+1,600 to +2,000 V).

Incidentally, by setting an electric potential gradient, residual toner on the secondary intermediate transfer drum 53 and so on is collected in the final transfer roll 60 in the cleaning step. Then, the collected residual toner is removed by a cleaning blade 801 or the like of a cleaning unit 80 brought into pressure contact with the surface of the final transfer roll 60.

EXAMPLE 9

Next, the present inventors manufactured an image recording apparatus as shown in FIG. 7, by way of trial. Then, experiments were carried out to investigate initial transfer residual density as an initial toner image transfer rate, and transfer residual density after transferring 10 thousand times. There was used an image carrier in which a hexamethyldisilazane solution in which 0.15 μm silica particulates were dispersed was applied onto an OPC photosensitive body. The thickness of a particulate layer was 0.5 μm, and spherical particulates were used. In addition, there was used an intermediate transfer drum the substrate of which was formed of silicon rubber (JISA hardness 30°) 3 mm thick, as shown in FIG. 8. In the intermediate transfer drum, a fluoro-resin layer (20 μm thick) was provided as the surface layer. The microhardness of the intermediate transfer drum was 45°. Incidentally, the microhardness was measured by use of "Micro durometer (type MD-1)" made by KOBUNSHI KEIKI CO., LTD.

As a result, it was proved that the initial transfer residual density showing the initial toner image transfer rate, and the transfer residual density after transferring 10 thousand times were very low and very satisfactory to be 0.01 and 0.02 respectively.

EXAMPLE 10

In addition, the present inventors manufactured an image recording apparatus as shown in FIG. 7, by way of trial. Then, experiments were carried out to investigate initial transfer residual density as an initial toner image transfer rate, and transfer residual density after transferring 10 thousand times. There was used an image carrier in which a hexamethyldisilazane solution in which 40 nm titania particulates were dispersed was applied onto an OPC photosensitive body. As the titania particulates, there were used ones the resistance value of which was changed variously. The thickness of a titania particulate layer was 0.5 μm. There were used titania particulates having resistance values of $10^{10}$ Ωcm, $10^8$ Ωcm, $10^{14}$ Ωcm, and $10^7$ Ωcm, respectively.

As a result, when the thickness of a titania particulate layer was 0.5 μm, and the resistance value was $10^{10}$ Ωcm, it was proved that the initial transfer residual density showing the initial toner image transfer rate, and the transfer residual density after transferring 10 thousand times were very low and satisfactory to be 0.02 and 0.05 respectively. In addition, when the thickness of a titania particulate layer was 0.5 μm, and the resistance value was $10^8$ Ωcm or $10^{14}$ Ωcm, it was proved that the initial transfer residual density showing the initial toner image transfer rate, and the transfer residual density after transferring 10 thousand times were low and satisfactory to be 0.02 and 0.06 respectively.

However, when the thickness of a titania particulate layer was 0.5 μm, and the resistance value was low to be $10^7$ Ωcm, there was a defect in image quality. Thus, such setting was disapproval. This is believed as follows. That is, if the resistance value of the particulate layer is low to be $10^7$ Ωcm, charges move out of an image area when an electrostatic latent image is formed on the particulate layer. Thus, a defect in image quality is produced.

EXAMPLE 11

Further, the present inventors manufactured an image recording apparatus as shown in FIG. 7, by way of trial. Then, experiments were carried out to investigate initial transfer residual density as an initial toner image transfer rate, and transfer residual density after transferring 10 thousand times, while changing the properties of intermediate transfer drums. At that time, as the intermediate transfer drums, there were used ones in which an elastic layer was formed on a material having a JISA hardness of 40°, the microhardness of the surface of the intermediate transfer drum was 70°, and the thickness of a surface resin layer was 25 μm, respectively.

As a result, when ones in which an elastic layer was formed on a material having a JISA hardness of 40° were used as the intermediate transfer drums, the initial transfer residual density showing the initial toner image transfer rate was indeed 0.02 in an acceptable range, but deteriorated slightly in comparison with that when ones in which an elastic layer was formed on a material having a JISA hardness of 30° or less were used as the intermediate transfer drums. In addition, in the former, the transfer residual density after transferring 10 thousand times was satisfactory to be 0.04. However, it was proved that it was preferable that the JISA hardness was not larger than 30°. In addition, when ones in which the microhardness of the surface was 70° were used as the intermediate transfer drums, the initial transfer residual density showing the initial toner image transfer rate was indeed 0.04 in an acceptable range, but deteriorated slightly in comparison with that when ones in which the microhardness of the surface was 60° or less were used as the intermediate transfer drums. In addition, in the former, the transfer residual density after transferring 10 thousand times was satisfactory to be 0.06. However, it was proved that it was preferable that the microhardness of the surface was not larger than 60°. Further, when ones in which the thickness of the surface resin layer was 25 μm were used as the intermediate transfer drums, the initial transfer residual density showing the initial toner image transfer rate was indeed 0.03 in an acceptable range, but deteriorated slightly in comparison with that when ones in which the thickness of the surface resin layer was 20 μm or less were used as the intermediate transfer drums. In addition, in the former, the transfer residual density after transferring 10 thousand times was satisfactory to be 0.06. However, it was proved that it was preferable that the thickness of the surface resin layer was not larger than 20 μm.

Embodiment 5

Figure 10:
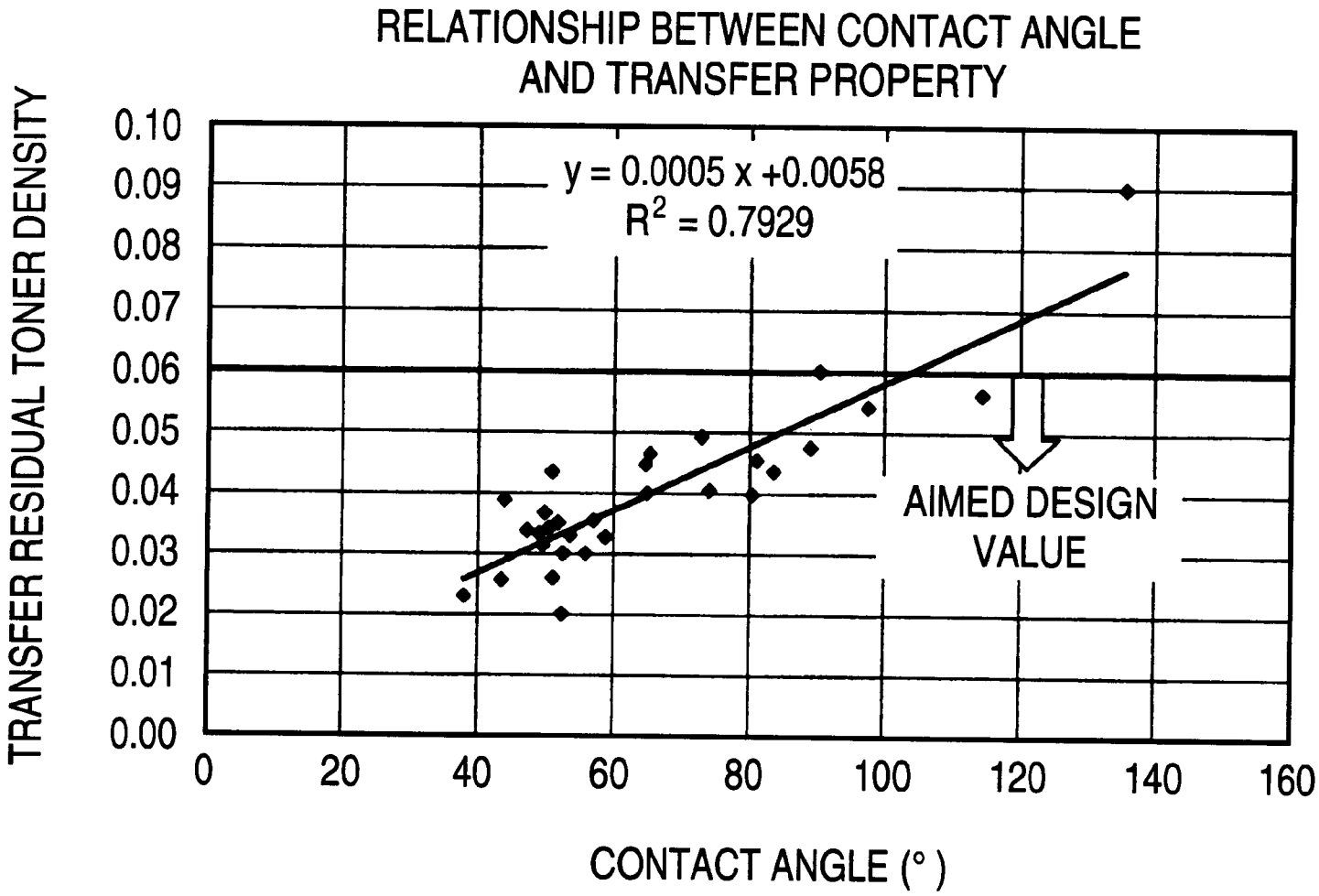
FIG. 10 is a graph showing the relationship between the contact angle of the surface of an image carrier and the transfer residual toner density.

FIG. 10 shows Embodiment 5 of the present invention. In Embodiment 5, in an image recording apparatus for recording an image by forming a toner image on the surface of an image carrier, the image carrier has hydrophobic-treated particulates on the surface, and the contact angle of the image carrier having the particulates on the surface is designed to be not larger than 100°, preferably not larger than 90°.

That is, in Embodiment 5, the surface of the image carrier is formed of a material having a high affinity to particulates the particle size of which is smaller than toner and the surfaces of which have been treated to be hydrophobic. A layer of the particulates treated to be hydrophobic is provided on the surface of the image carrier. In addition, the contact angle of the image carrier having the particulates on the surface is designed to be not larger than 100°, preferably not larger than 90°.

According to the acute investigation of the present inventors about the relationship between the contact angle of the image carrier and the transfer property, it was proved that if the contact angle was not smaller than 100°, the initial transfer rate was indeed excellent, but the tenability thereof was not excellent, though the reason was not seen well. On the contrary, it was proved that if the contact angle was not larger than 100°, both the initial transfer rate and the tenability thereof were very excellent, and particularly if the contact angle was not larger than 90°, they were especially excellent. It is estimated that when the image carrier has a contact angle not smaller than 100°, the adhesive force of the particulates to the image carrier is weak enough to be detached easily.

EXAMPLE 12

Therefore, the present inventors manufactured image recording apparatus in which the contact angle of the image carrier surface with respect to pure water was changed variously. Then, experiments were carried out to investigate what relationship was between the contact angle of the image carrier surface and the transfer residual toner density.

As a result, as shown in FIG. 10, it was proved that if the contact angle of the image carrier surface was not larger than 100°, the transfer residual toner density was low and excellent to be 0.06 or less, and further if the contact angle of the image carrier surface was not larger than 90°, the transfer residual toner density was very low and very satisfactory to be 0.05 or less.

As has been described above, according to the present invention, a particulate layer was formed on the surface of an image carrier, but in an image recording apparatus using an intermediate transferor, the particulate layer may be formed on the intermediate transferor. Thus, it is possible to improve the efficiency when a toner image is transferred from the intermediate transferor to a recording sheet or another intermediate transferor.

In addition, according to the present invention, means for improving the transfer efficiency is adopted. Thus, it is possible provide an image recording apparatus and an image recording method in which an excellent recorded image can be obtained without any cleaning unit or with a very simple cleaning unit in accordance with necessity. In the image recording apparatus or method having no cleaning unit, the following means can be selected for the management of residual toner on the image carrier after transfer. First means is to recover the residual toner by a developing unit. Since the residual toner is removed by the developing unit according to this means, it is possible to prevent an image defect such as a ghost or the like from being produced. In addition, the transfer efficiency is improved so that the quantity of recovered toner is reduced, and the influence of toner in the developing unit on the charging quantity is reduced. Second means is to provide particulate supply means or particulate smoothing means separately from the developing unit so that the residual toner is recovered by the particulate supply means or the particulate smoothing means. Accordingly, as the particulate supply means or the particulate smoothing means, there are adopted one which forms an electric field between the image carrier and the particulate supply means or the particulate smoothing means so as to recover toner; one which recovers residual toner with a brush or the like rubbed against the image carrier; and so on. According to such means, not only is it possible to prevent an image defect such as a ghost or the like effectively, but it is also possible to prevent foreign matters such as paper dust or the like from entering the developing unit. Third means is to form and a next image on residual toner without recovering the residual toner, and transfer the residual toner to a recording sheet or an intermediate transferor together with this new image. In this apparatus or method, by the means for improving the transfer efficiency, transfer is carried out with efficiency high enough not to produce an image defect such as a ghost or the like. According to such means, there is no fear that foreign matters such as paper dust or the like enter the developing unit, and it is possible to eradicate the production of toner to be recovered and abolished.

What is claimed is:

1. An image carrier for carrying a toner image, wherein a surface of said image carrier is formed with a first hydrophobic material having an affinity to particulates having a particle size smaller than that of toner, wherein the particulates have surfaces treated to be hydrophobic with a second hydrophobic material.

2. An image recording apparatus, comprising:

an image carrier provided with a surface for carrying a toner image, wherein the surface of the image carrier is formed with a first hydrophobic material;

particulates provided as a layer on the image carrier, wherein the particulates have a particle size smaller than that of toner, wherein a surface of the particulates is treated with a second hydrophobic material, whereby the first hydrophobic material on the surface of the image carrier has a high affinity for the particulates, whereby an image is recorded by forming a toner image on the surface of the image carrier.

3. The image recording apparatus according to claim 2, wherein the first hydrophobic material has a boiling point at least not higher than 150° C. or is formed of a hydrophobic treatment agent which is hydrolyzed at a temperature not higher than 150° C.

4. An image recording apparatus according to claim 2, wherein said material having a high affinity to said particulates treated to be hydrophobic is formed of a material which is the same as that of a hydrophobic treatment agent with which said particulates are surface-treated to be hydrophobic, or a material having a difference of 1.1 or less in SP (Solubility Parameter) value from said hydrophobic treatment agent.

5. The image recording apparatus according to claim 2, wherein the second hydrophobic material is formed of a material which has a low affinity to said surface layer of said image carrier and which is dispersed in said surface layer of said image carrier.

6. An image recording apparatus according to claim 2, wherein when said image carrier is constituted by a photosensitive body, said particulates have light transmission property.

7. The image recording apparatus according to claim 2, wherein particulate supplying means is provided so as to supply said surface of said image carrier with the particulates which are smaller in particle size than toner.

8. An image recording apparatus according to claim 7, wherein said particulate supplying means is constituted by developing means for supplying said particulates at the same as development.

9. An image recording apparatus according to claim 2, wherein said apparatus includes particulate smoothing means for smoothing said particulates which are smaller in particle size than toner and which have been supplied to said surface of said image carrier.

10. An image recording apparatus according to claim 9, wherein said particulate smoothing means is constituted by a rotatable brush.

11. An image recording apparatus according to claim 10, wherein said particulate smoothing means is constituted by a rotatable roll or an endless belt.

12. An image recording apparatus according to claim 10, wherein abrasive particulates other than said particulates are contained.

13. An image recording apparatus according to claim 12, wherein said abrasive particulates are contained in a developer.

14. An image recording apparatus according to claim 2, wherein thickness of said particulate layer is not larger than 3 $\mu$m.

15. An image recording apparatus according to claim 14, wherein volume resistivity of said particulate layer is in a range of from $10^8$ Ωcm to $10^{14}$ Ωcm.

16. An image recording apparatus according to claim 2, wherein particulates of the same kind as said particulates are made to adhere to a surface of said toner.

17. An image recording apparatus according to claim 2, wherein a contact angle of said surface of said image carrier having particulates thereon is not larger than 100°, preferably not larger than 90°.

18. An image recording apparatus according to claim 2, where said toner is constituted by spherical toner.

19. An image recording method for recording an image by forming a toner image on a surface of an image carrier, comprising the steps of:

forming a latent image on said image carrier, said image carrier being formed with a first hydrophobic material having a high affinity to particulates smaller in particle size than that of toner being made to adhere to the image carrier, wherein the surface of the particulates is treated with a second hydrophobic material;

transferring the toner selectively onto a layer of the particulates substantially uniformly adhering onto the image carrier, so as to form a toner image; and transferring the toner image to a recording medium or an intermediate transferor.

20. An image recording method according to claim 19, wherein a surface of said intermediate transferor is formed of a material having a high affinity to particulates treated to be hydrophobic, and wherein said particulates having particle size smaller than that of toner are made to adhere to said surface of said intermediate transferor.

* * * * *